US006963720B2

(12) United States Patent
Endo et al.

(10) Patent No.: US 6,963,720 B2
(45) Date of Patent: Nov. 8, 2005

(54) IMAGE FORMING METHOD AND IMAGE FORMING APPARATUS WITH TONER HAVING SPECIFIC CHARACTERISTIC

(75) Inventors: Isao Endo, Hachioji (JP); Hiroyuki Yamada, Hachioji (JP)

(73) Assignee: Konica Corporation, Tokyo (JP)

( * ) Notice: Subject to any disclaimer, the term of this patent is extended or adjusted under 35 U.S.C. 154(b) by 56 days.

(21) Appl. No.: 10/226,831

(22) Filed: Aug. 23, 2002

(65) Prior Publication Data

US 2003/0049058 A1 Mar. 13, 2003

(30) Foreign Application Priority Data

Sep. 3, 2001 (JP) ..... 2001-265221
Sep. 3, 2001 (JP) ..... 2001-265222

(51) Int. Cl.[7] ..... G03G 21/00
(52) U.S. Cl. ..... 399/349; 430/110.3
(58) Field of Search ..... 399/349, 350, 399/357, 343, 252, 359; 430/110.1, 110.3, 110.4

(56) References Cited

U.S. PATENT DOCUMENTS 4,252,433 A * 2/1981 Sullivan ..... 399/357
5,689,768 A * 11/1997 Ehara et al. ..... 399/96
6,461,780 B2 * 10/2002 Itami et al. ..... 430/58.15
6,480,695 B2 * 11/2002 Endo et al. ..... 399/349
6,580,897 B2 * 6/2003 Sato et al. ..... 399/350
6,621,999 B2 * 9/2003 Miho ..... 399/252
6,640,080 B2 * 10/2003 Endo et al. ..... 399/349
6,649,315 B1 * 11/2003 Takasaki ..... 430/110.3

FOREIGN PATENT DOCUMENTS

EP 1220055 3/2002
JP 08152831 A * 6/1996 ..... G03G/21/10
JP 2000214629 A * 8/2000 ..... G03G/9/08
JP 188452 7/2001

* cited by examiner

*Primary Examiner*—Robert Beatty
(74) *Attorney, Agent, or Firm*—Lucas and Mercanti LLP

(57) ABSTRACT

In a toner image forming method, toner contains toner particles having a shape coefficient falling within a range of 1.0 to 1.6 in an amount of 65% by number or more and the toner particles has a variation coefficient of the shape coefficient of 16% or less. In a step of cleaning residual toner remaining on the image carrying member after the step of transferring; the cleaning step includes a step of removing electrostatically residual toner by brining a cleaning roller in contact with a surface of the image carrying member and by applying a bias voltage between the cleaning roller and the image carrying member, and a step of removing mechanically residual toner by bringing a tip end of a cleaning blade in contact with a surface of the image carrying member at a position downstream of the cleaning roller in terms of the rotating direction of the image carrying member.

32 Claims, 6 Drawing Sheets

IMAGE FORMING METHOD AND IMAGE FORMING APPARATUS WITH TONER HAVING SPECIFIC CHARACTERISTIC

BACKGROUND OF THE INVENTION

This invention relates to an image forming method and an image forming apparatus.

In recent years, in an image forming apparatus based on an electrophotographic method, it is required to make toner particles have small particle diameter; as regards a method for obtaining such toner particles, for example, a polymerization method such as a suspension polymerization method or an emulsion polymerization method has been appropriately utilized.

However, as the result, with the toner particles being made to have small particle diameter, the adhering force of toner particles to an image carrying member becomes larger, it is produced a problem that, by a cleaning device, for example, of a cleaning blade method in which residual toner particles on an image carrying member are removed by rubbing the surface of the image carrying member with a cleaning blade in pressing contact with it, it becomes extremely difficult to remove residual toner particles such as un-transferred toner particles or after-transfer residual toner particles on the image carrying member. In particular, in the case where what is called a polymerization toner produced by a polymerization method is used, in addition to the factor of the particle diameter, because the shape of the toner particles becomes near to a sphere, occurrence of poor cleaning, that is, what is called "passing through" phenomenon in which toner particles roll on the image carrying member to pass under the cleaning blade, occurs remarkably.

In order to prevent the above-mentioned occurrence of poor cleaning, a cleaning method in which mechanical cleaning with a cleaning blade and electrostatic cleaning are both used is disclosed in the publication of the unexamined patent application H3-179675 etc.

To state it concretely, it has a structure such that, at an upstream position of a cleaning blade with respect to the moving direction of the image carrying member, a brush roller made of an electrically conductive material is mounted, and a suitable-magnitude bias voltage having the reverse polarity to the residual toner particles on the image carrying member is applied to this brush roller, and it is intended to improve the cleaning performance by the mechanical cleaning effect of the cleaning blade and the electrostatic cleaning effect of the brush roller.

However, it has been proved that, even in an image forming apparatus equipped with a cleaning device of a cleaning method as described in the above, it was difficult to remove residual toner particles on an image carrying member with certainty, and image defects such as background density and white streaks or black streaks due to the contamination of the charging electrode in the charging means were produced, which made it difficult to form a high-quality image after all.

SUMMARY OF THE INVENTION

This invention has been made on the basis of the above-mentioned situation, and it is its object to provide an image forming method and an image forming apparatus to make it possible to remove residual toner particles on an image carrying member with certainty and accordingly to make it possible to form a high-quality image stably over a long period of time.

The above-mentioned object can be accomplished by any one of the following structures.

An image forming method comprising a developing process to form a toner image by developing an electrostatic latent image formed on an image carrying member, which is being driven to rotate, by a developing device, and a cleaning process to remove by a cleaning device residual toner particles remaining on the image carrying member having passed a transfer region for transferring the toner image having been formed on the image carrying member onto a recording material characterized by it that, in said developing process, an electrostatic latent image is visualized by a toner composed of toner particles including those particles in an amount of 65% by number or more which have a shape coefficient falling within a range of 1.0 to 1.6 and having a variation coefficient of the shape coefficient of not greater than 16%, and in said cleaning process, residual toner particles remaining on the image carrying member are removed electrostatically by a cleaning roller provided in such a way as to be in contact with the image carrying member and to extend in the axial direction of the image carrying member with a bias voltage applied by a bias voltage applying means, and mechanically by a cleaning blade rubbing the surface of the image forming member provided in such a way as to have its front edge brought in contact with the surface of said image carrying member at a downstream position of said cleaning roller with respect to the moving direction of the image carrying member and to extend in the axial direction of the image carrying member.

In the above-mentioned another structure of an image forming method of this invention, it is desirable to use a toner composed of toner particles including those particles in an amount of 65% by number or more which have a shape coefficient falling within a range of 1.2 to 1.6.

Further, it may be also appropriate to use a toner composed of toner particles having a number-average particle diameter of 3 to 8 $\mu$m.

In the above-mentioned another structure of an image forming method of this invention, it is desirable to use at least a toner composed of toner particles obtained by polymerizing a polymerizable monomer in an aqueous medium, and it is more desirable to use at least a toner composed of toner particles obtained by associating resin particles in an aqueous medium.

It may be also appropriate to make the above-mentioned another structure of an image forming method of this invention further comprise a collecting transporting process for collecting and transporting the residual toner particles removed by the cleaning device to the developing device, to make it possible to utilize again the collected residual toner particles.

Another structure of an image forming apparatus of this invention is an image forming apparatus comprising an image carrying member to be driven to rotate, a developing device for forming a toner image by developing an electrostatic latent image formed on this image carrying member, and a cleaning device for removing toner particles remaining on the image carrying member having passed a transfer region for transferring a toner image having been formed on said image carrying member onto a recording material characterized by it that said cleaning device comprises a cleaning roller provided in such a way as to be in contact with the surface of the image carrying member and to extend in the axial direction of the image carrying member, a bias voltage applying means for applying a bias voltage to this cleaning roller, and a cleaning blade provided in such a way as to have its front edge brought in contact with the surface of the image carrying member at a downstream position of said cleaning roller with respect to the moving direction of the image carrying member and to extend to the axial direction of the image carrying member, and said toner is composed of toner particles including those particles in an amount of 65% by weight or more which have a shape coefficient falling within a range of 1.0 to 1.6 and having a variation coefficient of the shape coefficient of not greater than 16%.

In the above-mentioned another structure of an image forming apparatus of this invention, it is desirable to use a toner composed of toner particles including those particles in an amount of 65% by number or more which have a shape coefficient falling within a range of 1.2 to 1.6.

Further, in the above-mentioned another structure of an image forming apparatus of this invention, it is possible to use a toner composed of toner particles having a number-average particle diameter of 3 to 8 $\mu$m.

In the above-mentioned another structure of an image forming apparatus of this invention, it is desirable to use at least a toner composed of toner particles obtained by polymerizing a polymerizable monomer in an aqueous medium, and it is more desirable to use at least a toner composed of toner particles obtained by associating resin particles in an aqueous medium.

As regards the above-mentioned another structure of an image forming method of this invention, it is possible to make it be provided with a collecting transporting mechanism for collecting toner particles removed by the cleaning device and transporting them to the developing device.

As the result of a diligent investigation of the inventors of this invention, it has been made clear that it was difficult to remove the residual toner particles on an image carrying member by merely employing a cleaning method using both electrostatic cleaning by a cleaning roller and mechanical cleaning by a cleaning blade. The reason for this can be considered in such ways as shown in (1) to (3) described below.

(1) Because the charge quantity of toner particles is not uniform from one particle to another but has a broad charge quantity distribution, on a toner particle having a high charge quantity, a strong adhering force to the image carrying member acts, while on a toner particle having a low charge quantity (weakly charged toner particle) or a toner particle having charge of reverse polarity (reversely charged toner particle), an extremely weak electrostatic driving force to move it to the bias roller acts; therefore, it is difficult to remove residual toner particles electrostatically with certainty.

(2) Because the shape of toner particles is not uniform from one particle to another, and the charging area in toner particles varies from one particle to another, which makes the charge quantity distribution broad, poor cleaning as mentioned in the above (1) is easy to occur. Further, because the adhering force of toner particles to the image carrying member varies from one particle to another, it is difficult to remove all the residual toner particles by an electrostatic cleaning force which is controlled to a definite strength.

(3) If a toner particle having extraordinarily anomalous shape as compared to other particles is present, said toner particle is broken while it is stirred in the developing device, sometimes to produce very fine powders having a size of about 1 to 2 $\mu$m; such very fine toner powders are difficult to remove with certainty by an electrostatic cleaning method or by a mechanical cleaning method too.

As the result of that, even in the case where toner particles remaining on an image carrying member are removed by a cleaning method using both electrostatic cleaning by a cleaning roller and mechanical cleaning by a cleaning blade, by specifying the structure of the toner itself (the particle diameter of the toner particles), it was found that the above-mentioned object could be accomplished, and this invention could be completed.

That is, by a toner composed of toner particles which have their shape made even, include those particles in an amount of 65% by number or more which have shape coefficient falling within a range of 1.0 to 1.6, and have the variation coefficient of the shape coefficient not greater than 16%, because the particle diameter distribution of the toner particles becomes extremely sharp, the charging area becomes approximately uniform over the whole toner particles, which makes the charging ability even over the whole toner particles; as the result of this, the charge quantity distribution in the toner particles can be made extremely sharp, and it becomes extremely small the proportion of the toner particles being present which have an extremely high charge quantity or an extremely low charge quantity as compared to other toner particles or are reversely charged; thus, the expected cleaning effect by the cleaning roller can be exhibited with certainty, and on top of it, it becomes possible to use a toner composed of toner particles having number-average particle diameter of 3 to 8 $\mu$m appropriately; hence, a high-quality image can be formed with certainty.

Further, it becomes extremely small the proportion of those toner particles being present which have a shape near to an exact sphere or such an extraordinarily anomalous shape as to make it easy to produce very fine powders, and a high cleaning effect can be exhibited with certainty.

Further, even in the case where the residual toner particles removed from on the image carrying member by the cleaning device are collected and utilized again, owing to the toner being composed of toner particles having their particle diameter made even, the degree of the difference in the charging ability between the collected toner particles and the unused toner particles becomes small; therefore, a stable developing performance can be obtained, while the expected cleaning effect by the cleaning roller can be exhibited with certainty; thus, a high-quality image can be formed with certainty.

An image forming method of this invention is an image forming method comprising a developing process to form a toner image by developing an electrostatic latent image formed on an image carrying member, which is being driven to rotate, by a developing device, and a cleaning process to remove by a cleaning device residual toner particles remaining on the image carrying member having passed a transfer region for transferring the toner image having been formed on the image carrying member onto a recording material characterized by it that, in said developing process, an electrostatic latent image formed on the image carrying member is visualized by a toner composed of toner particles having a number variation coefficient in the particle diameter distribution by number of not greater than 27%, and in said cleaning process, residual toner particles remaining on the image carrying member are removed electrostatically by a cleaning roller provided in such a way as to be in contact with the image carrying member and to extend in the axial direction of the image carrying member with a bias voltage applied by a bias voltage applying means, and mechanically by a cleaning blade rubbing the surface of the image forming member provided in such a way as to have its front edge brought in contact with the surface of said image carrying member at a downstream position of said cleaning roller with respect to the moving direction of the image carrying member and to extend in the axial direction of the image carrying member.

In the above-mentioned structure of an image forming method of this invention, it is also appropriate to use a toner composed of toner particles having a number-average particle diameter of 3 to 8 μm.

Further, in the above-mentioned structure of an image forming method of this invention, it is desirable to use a toner such that, with the particle diameter of toner particles denoted by D(μm), and the abscissa representing natural logarithm lnD, in a histogram showing the particle diameter distribution based on the number of the particles to be obtained by dividing this abscissa into a plurality of classes at intervals of 0.23, the sum (M) of the relative frequency (m1) of the toner particles included in the highest-frequency class and the relative frequency (m2) of the toner particles included in the class of the next highest-frequency to said highest-frequency class is not smaller than 70%.

In the above-mentioned structure of an image forming method of this invention, it is desirable to use at least a toner composed of toner particles obtained by polymerizing a polymerizable monomer in an aqueous medium, and it is more desirable to use at least a toner composed of toner particles obtained by associating resin particles in an aqueous medium.

It may be also appropriate to make the above-mentioned structure of an image forming method of this invention further comprise a collecting transporting process for collecting and transporting residual toner particles removed by the cleaning device to the developing device, to make it possible to utilize the collected residual toner particles again.

A structure of an image forming apparatus of this invention is an image forming apparatus comprising an image carrying member to be driven to rotate, a developing device for forming a toner image by developing an electrostatic latent image formed on this image carrying member, and a cleaning device for removing toner particles remaining on the image carrying member having passed a transfer region for transferring a toner image having been formed on said image carrying member onto a recording material characterized by it that said cleaning device comprises a cleaning roller provided in such a way as to be in contact with the surface of the image carrying member and to extend in the axial direction of the image carrying member, a bias voltage applying means for applying a bias voltage to this cleaning roller, and a cleaning blade provided in such a way as to have its front edge brought in contact with the surface of the image carrying member at a downstream position of said cleaning roller with respect to the moving direction of the image carrying member and to extend to the axial direction of the image carrying member, and said toner is composed of toner particles having a number variation coefficient in the particle diameter distribution by number of not greater than 27%.

In the above-mentioned structure of an image forming apparatus of this invention, it is possible to use a toner composed of toner particles having a number-average particle diameter of 3 to 8 μm.

Further, in the above-mentioned structure of an image forming apparatus of this invention, it is desirable said toner is such that, with the particle diameter of toner particles denoted by D(μm), and the abscissa representing natural logarithm lnD, in a histogram showing the particle diameter distribution based on the number of the particles to be obtained by dividing this abscissa into a plurality of classes at intervals of 0.23, the sum (M) of the relative frequency (m1) of the toner particles included in the highest-frequency class and the relative frequency (m2) of the toner particles included in the class of the next highest-frequency to said highest-frequency class is not smaller than 70%.

In the above-mentioned structure of an image forming apparatus of this invention, it is desirable to use at least a toner composed of toner particles obtained by polymerizing a polymerizable monomer in an aqueous medium, and it is more desirable to use at least a toner composed of toner particles obtained by associating resin particles in an aqueous medium.

As regards the above-mentioned structure of an image forming apparatus of this invention, it is possible to make it a structure provided with a collecting transporting mechanism for collecting toner particles removed by the cleaning device and transporting them to the developing device.

According to the result of a diligent investigation of the inventors of this invention, it has been made clear that remaining toner particles on an image carrying member had their charge quantity not uniform from one to another particle, to have a broad charge quantity distribution, therefore, a toner particle having a high charge quantity had a strong adhering force to the image carrying member, and a toner particle having a low charge quantity (weekly charged toner particle) or a toner particle having a charge of the reverse polarity (reversely charged toner particle) was difficult to remove electrostatically because the electrostatic driving force for moving them to the bias roller was extremely small; it has been found that in the case where toner particles remaining on an image carrying member were removed by a cleaning method using both electrical cleaning by a cleaning roller and mechanical cleaning by a cleaning blade, the above-mentioned object could be accomplished by specifying the structure of the toner itself (particle diameter of the toner particles); thus, this invention could be completed.

That is, by a toner composed of toner particles having their particle diameter made even and a number variation coefficient of not greater than 27%, owing to its particle diameter being made extremely sharp, the charging area becomes approximately equal over the whole toner particles, to make the charging ability of the toner particles uniform over the whole particles; as the result of this, it is possible to make the charge quantity distribution of the toner particles extremely sharp, which makes extremely small the proportion of those toner particles being present which have an extremely high charge quantity or extremely low charge quantity as compared to other particles; accordingly, the expected cleaning effect by the cleaning roller can be exhibited with certainty, and on top of it, a toner composed of toner particles having number-average particle diameter of 3 to 8 μm, which have been difficult to remove by a conventional cleaning device, can be appropriately used; hence, a high-quality image can be formed with certainty.

Further, even in the case where residual toner particles removed from on the surface of an image carrying member by a cleaning device are collected and utilized again, by a toner being composed of toner particles with the particle diameter made even, the degree of the difference of charging ability between collected toner particles and unused toner particles is made small; therefore, stabilized developing capability can be obtained, while the expected cleaning effect by the cleaning roller can be exhibited with certainty and a high-quality image can be formed with certainty.

DETAILED DESCRIPTION OF THE PREFERRED EMBODIMENT

In the following, with reference to the drawings, this invention will be explained in detail.

Figure 1:
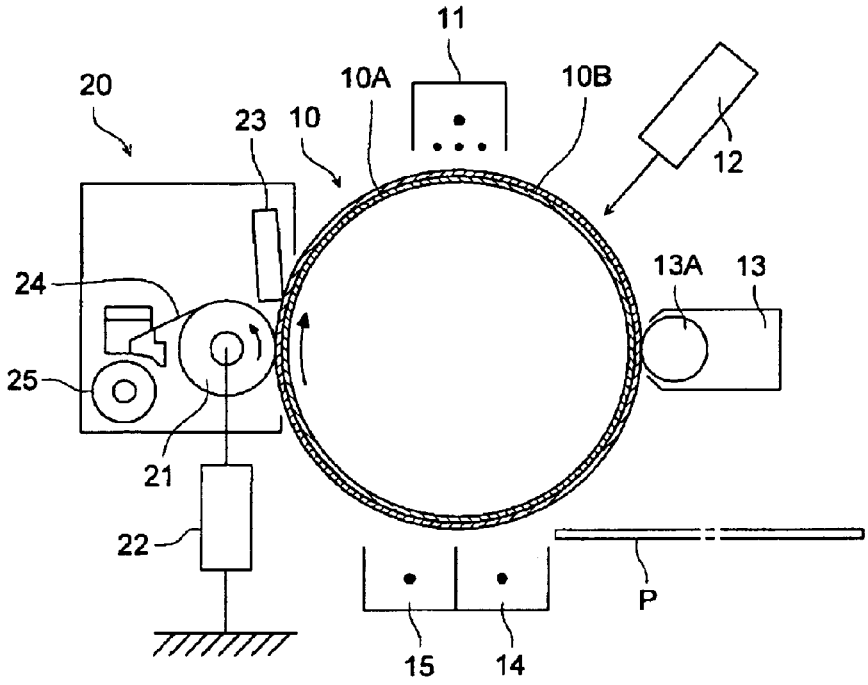
FIG. 1 is an explanatory drawing showing the outline of the structure of an example of an image forming apparatus of this invention.

FIG. 1 is an explanatory drawing showing the outline of the structure of an example of an image forming apparatus of this invention.

This image forming apparatus is equipped with a drum-shaped photoreceptor 10 as an image carrying member driven to rotate, a charging device 11 for uniformly charging the surface of this photoreceptor 10, an exposure device 12 for forming an electrostatic latent image by exposing the surface of the photoreceptor 10 having been charged by this charging device 11, a developing device 13 for forming a toner image composed of toner particles through making the electrostatic latent image formed by this exposure device 12 a visible image by using a developer including a toner, a transfer device 14 for transferring the toner image formed on the photoreceptor 10 onto a recording material P in a transfer region, a detaching device 15 for detaching the recording material P closely adhering to the photoreceptor 10, and a cleaning device 20 for removing toner particles on the photoreceptor 10 having passed the transfer region.

The photoreceptor 10 is composed of a photosensitive layer 10B formed on the outer circumferential surface of, for example, a drum-shaped metallic base member 10A, and is arranged in such a state that it extends in the width direction of the recording material P to be transported (the direction perpendicular to the paper surface in FIG. 1).

As regards the kind of the photosensitive layer 10B, it is not to be particularly limited, but for example, an inorganic photosensitive layer composed of selenium, arsenic selenide, amorphous selenium (a-Se), cadmium sulfide (CdS), zinc oxide (ZnO), amorphous silicon (a-Si), or the like, and an organic photosensitive layer composed of an organic photoconductive compound can be cited.

A desirable example of the embodiment of the photoreceptor 10 is an organic photoreceptor formed of a photosensitive layer composed of resin containing an organic photoconductor, and it is particularly desirable a photoreceptor of separated function type formed of a charge transport layer and a charge generation layer laminated.

The developing device 13 is equipped with a developing sleeve 13A which is arranged in such a way as to face the photoreceptor 10 with the developing region positioned in between, and to this developing sleeve 13A, it is applied, for example, a direct current developing bias voltage having the same polarity as the charging of the charging device 11, or an alternate current voltage with a direct current voltage having the same polarity as the charging of the charging device 11 superposed; by this, a reverse development, in which toner particles are deposited on the exposure area exposed to the light from the exposure device 12, is carried out.

The cleaning device 20 comprises a cleaning roller 21 provided in such a way as to be brought in contact with the surface of the photoreceptor 10 to form a nip portion, a bias voltage applying means 22 consisting of, for example, a constant-current power source for applying a bias voltage to the cleaning roller 21, and a flat-plate-shaped cleaning blade 23 provided in such a way as to have its front edge directed towards the direction reverse to the moving direction of the photoreceptor 10 and brought in pressing contact with the surface of the photoreceptor at a downstream position of the cleaning roller 21 with respect to the moving direction of the photoreceptor 10; both the cleaning roller 21 and the cleaning blade 23 are arranged in such a way as to extend to the axial direction of the photoreceptor 10 (the direction perpendicular to the paper surface).

From the viewpoint of obtaining a good pressing contact state with the photoreceptor 10, the cleaning roller 21 is made up of an elastomer; as regards the material of the elastomer, rubber material such as silicone rubber or polyurethane rubber, foamed material, or material composed of foamed material covered with resin etc. can be used.

It is desirable that the cleaning roller 21 has a hardness of 5 to 60°, and it is more desirable that it has a hardness of 10 to 50°. If the hardness of the cleaning roller 21 is smaller than 5°, it is impossible to secure a sufficient durability (mechanical strength), and it becomes difficult to obtain the expected cleaning effect. On the other hand, if the hardness is greater than 60°, it is impossible to secure a sufficient contact width (nip) with the photoreceptor 10; therefore, it is difficult to obtain the expected cleaning effect, and on top of it, a damage etc. is easy to be produced on the surface of the photoreceptor 10.

In addition, the hardness of the cleaning roller 21 is one that is measured on the basis of JIS K6301.

Although the width of the nip between the cleaning roller and the photoreceptor 10 varies in accordance with the diameter of the cleaning roller 21 too, it should desirably be 0.2 to 5 mm, and it should more desirably be 0.5 to 3 mm. If the nip width is smaller than 0.2, it becomes difficult to obtain the expected cleaning effect, and on the other hand, if the nip width is greater than 5 mm, a damage etc. becomes easy to be produced on the surface of the photoreceptor 10.

It is desirable that the cleaning roller has an electrically conductive or semiconductive nature and the resistivity of its surface layer is $10^2$ to $10^{10}$ Ωcm. If the resistivity of the surface layer is smaller than $10^2$ Ωcm, banding due to discharging etc. become easy to be produced. On the other hand, if it becomes greater than $10^{10}$ Ωcm, an electric potential difference required for removing toner particles cannot be obtained, and poor cleaning tends to occur.

In addition, the resistivity of the surface layer can be adjusted by adding a conductive material, for example, carbon, metal, conductive polymer, etc., or by introducing a polar radical into the rubber-like polymer composing the elastomer material.

It is desirable that the cleaning roller 21 is rotated in the direction such that its circumference moves with the circumference of the photoreceptor 10 at its contact position with the photoreceptor 10, that is, it is rotated in the reverse direction of the rotating direction of the photoreceptor 10 (counter clockwise direction in the example shown in the drawing). If it is rotated in the direction such that its circumference moves against the circumference of the photoreceptor 10 at its contact position with the photoreceptor 10, in the case where excessive toner particles are present on the surface of the photoreceptor 10, the toner particles removed by the cleaning roller 21 fall off the roller and smudge the recording material P or the inside of the machine in some cases.

It is desirable that the ratio (Vr/Vp) of the linear velocity of the cleaning roller 21 (Vr) to the linear velocity of the photoreceptor 10 (Vp) is 0.5 to 2. If the linear velocity ratio (Vr/Vp) is smaller than 0.5, cleaning force is lowered, to make the smudging of image easy to be produced. On the other hand, if the linear velocity ratio (Vr/Vp) is greater than 2, a damage etc. tends to be produced on the surface of the photoreceptor 10 in the case where an alien substance is gripped in between.

As described in the above, a bias voltage is applied to the cleaning roller 21, and it is made to flow an electric current which is controlled by a control means (not shown in the drawing) in order that a bias voltage having the reverse polarity to the toner used for visualizing the electrostatic latent image on the photoreceptor 10, for example a positive bias voltage in the case where toner is negatively charged, may be applied to the cleaning roller 21; by this, toner particles are electrostatically attracted to the cleaning roller 21 and removed from on the photoreceptor 10.

By making the bias voltage applying means consist of a constant-current power source, the potential difference between the roller surface and the surface of the photoreceptor 10 is controlled to be always constant; therefore, as compared to the case where a constant-voltage power source is used, unevenness of cleaning depending on the level and the polarity of the electric potential of the photoreceptor 10 and the occurrence of poor cleaning can be prevented with certainty.

Although the value of the electric current made to flow through the cleaning roller 21 by the bias voltage applying means 22 varies in accordance with the thickness of the photosensitive layer 10B of the photoreceptor 10 and the value of the resistivity of the surface layer of the cleaning roller 21, it is desirable that the absolute value of the current is 1 to 50 μA. If the current value is smaller than 1 μA, it becomes difficult to perform a sufficient cleaning. On the other hand, if it is greater than 50 μA, discharging etc. are easy to occur.

For example, in the case where the thickness of the photosensitive layer 10B of the photoreceptor 10 is 15 to 30 μm, and the resistivity of the surface layer of the cleaning roller 21 is $10^2$ to $10^{10}$ Ωcm, it is desirable that the absolute value of the electric current made to flow through the cleaning roller 21 is 5 to 40 μA.

Figure 2:
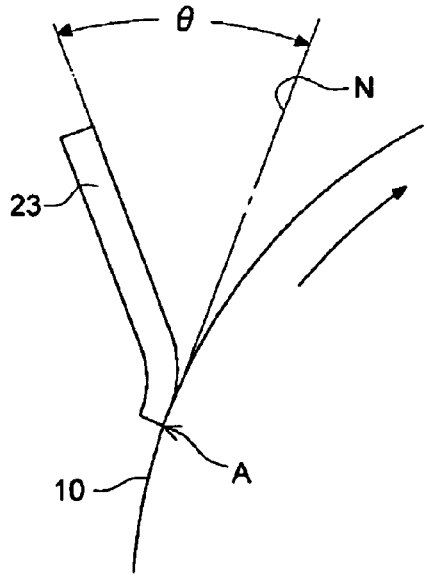
FIG. 2 is an explanatory drawing showing the working state of a cleaning blade.

As shown in FIG. 2, the cleaning blade 23 is supported by a suitable supporting member (not shown in the drawing) in a state such that it makes an inclination angle with the tangent plane N to the outer side (to the left in the drawing) at its contact position A with the surface of the photoreceptor 10, and in the operational state, it is brought in a state where the whole length of it is bending due to the elasticity of the cleaning blade 23 itself with its front edge directed towards the direction reverse to the moving direction of the surface of the photoreceptor 10 (counter direction), and is pressed to become in contact with the photoreceptor 10 in a state in which the pressing force to the surface of the photoreceptor 10 is controlled to be approximately constant over the whole length along the axial direction of the photoreceptor 10. At this time, it is desirable that the front edge portion of the cleaning blade 23 is brought in pressing contact having a certain area with the surface of the photoreceptor 10.

The cleaning blade 23 is made of, for example, a rubber elastomer, and for such a rubber elastomer, for example, urethane rubber, silicone rubber, fluorine-contained rubber, chloroprene rubber, butadiene rubber, etc. can be cited; it is particularly desirable to use, among these, urethane rubber, because it is excellent in wear-resistance ability as compared to other materials.

It is desirable that the pressing load per unit length of the cleaning blade 23 against the photoreceptor 10 is 0.1 to 30 g/cm, and more desirably it should be 1 to 25 g/cm. If the pressing load is smaller than 0.1 g/cm, the cleaning force is insufficient, which causes smudging of an image to tend to occur. On the other hand, if the pressing load is larger than 30 g/cm, the wear of the photoreceptor becomes larger, and background density and blur of an image becomes easy to be generated.

For the measurement of the pressing load, a method in which it is measured by pressing the front edge of the cleaning blade to a balance, a method in which it is measured electrically by placing a sensor such as a load cell at the position of the contact of the front edge of the cleaning blade 23 with the photoreceptor 10, etc. can be used.

It is desirable that the pressing contact angle θ of the cleaning blade 23 with the photoreceptor 10 is 0 to 40°, and more desirably it should be 0 to 25°. If the pressing contact angle θ is smaller than 0°, cleaning force is lowered and smudging of an image tends to occur. On the other hand, if the pressing contact angle θ is greater than 40°, what is called "blade turning over", which is a phenomenon of the front edge of the cleaning blade 23 bending reversely in compliance with the moving photoreceptor 20, tends to occur.

In addition, "the pressing contact angle θ with the photoreceptor 10" is an angle made by the tangent plane N at the pressing contact position of the front edge of the cleaning blade 23 with the inner surface of the base portion of the cleaning blade 23 (the surface facing the surface of the photoreceptor 10 in FIG. 2).

It is desirable that the hardness of the cleaning blade 23 is 20 to 90°, and it is particularly desirable to make it 60 to 80°. If the hardness of the cleaning blade 23 is smaller than 20°, the cleaning blade 23 is too soft and the phenomenon of blade turning over or poor cleaning tends to occur. On the other hand, if the hardness is greater than 90°, it becomes difficult to make the blade comply with a slight concave or convex portion on the surface of the photoreceptor 10 or an alien substance, and the "passing through" of toner particles tends to occur.

In the above, the hardness of the cleaning blade 23 is one that is measured on the basis of JIS K6301.

The thickness and the free length of the cleaning blade 23 are not to be particularly limited so long as the pressing load and the pressing contact angle of the cleaning blade 23 fall within the above-mentioned ranges respectively, but from the viewpoint of ease of control of the pressing load and the prevention of the occurrence of blade turning over, it is desirable that the thickness of the cleaning blade 23 is 1 to 3 mm, and more desirably it should be 1.5 to 2.5 mm; the free length should desirably be 2 to 20 mm, and more desirably it should be 3 to 15 mm. The term "free length" means the length of the part that is not constrained by a supporting member.

As regards the method of supporting the cleaning blade 23, it may be either a fixed supporting method in which the cleaning blade 23 is supported by a fixed blade holder in such a way that it is pressed to the surface of the photoreceptor 10 by the elastic force of its own, or a rotary supporting method in which the cleaning blade 23 is supported by a rotary blade holder and is brought in a pressing contact state by the action of a load such as a force of spring or a gravitational force.

In the above-mentioned cleaning device 20, there is provided a collecting transporting mechanism for collecting residual toner particles removed from on the photoreceptor 10 by the cleaning roller 21 and the cleaning blade 23 and transporting them to the developing device 13.

The collecting transporting mechanism is equipped with at least one collecting member 24 provided in contact with or in the neighborhood of the surface of the cleaning roller 21, and a collecting roller 25 arranged in such a way as to extend facing along the cleaning roller 21 at a position under the cleaning device 20 where the residual toner particles scraped off the surface of the cleaning roller 21 by this collecting member 24 and those removed from the surface of the photoreceptor by the cleaning blade 23 are to be collected.

The collecting member 24 can be made to have a structure such that one or two or more of it are provided in a counter type or a trail type arrangement with respect to the cleaning roller 21, and it is desirable that a plurality of them are provided. The reason for this is that a single collecting member 24 cannot certainly remove toner particles from the cleaning roller 21, because a bias voltage of the reverse polarity to the toner is applied to the cleaning roller 21, which makes large the adhering force of the toner particles to the cleaning roller 21, and there is some possible risk of smudging of an image being produced by the toner particles on the cleaning roller 21 falling off onto the recording material P due to vibration etc.

The collecting member 24 can be made up of a scraper, a bias roller, a fur blush, or the like composed of, for example, a phosphor bronze plate, a PET plate, a polycarbonate plate, or a complex member of these.

An image forming method of this invention comprises a developing process to form a toner image composed of toner particles by visualizing an electrostatic latent image formed on the photoreceptor 10, which is being driven to rotate, by the developing device 13, and a cleaning process to remove residual toner particles remaining on the photoreceptor 10, which has passed a transfer region for transferring the toner image having been formed on the photoreceptor 10 to a recording material P, by the cleaning device 20, and further it may comprise a collecting transporting process to collect residual toner particles removed by the cleaning device 20 to transport them to the developing device 13. To state it concretely, an image is formed in the following way.

That is, the surface of the photoreceptor 10, which is being driven to rotate, is charged in the specified polarity (negative polarity, for example) by the charging device 11, by exposing the surface of this photoreceptor 10 selectively to the light from the exposure device 12, the surface potential of the area exposed to the light (exposed area) is lowered, to form an electrostatic latent image corresponding to an original image.

Further, by applying a bias voltage to the developer sleeve 13A making up the developing device 13 by a voltage source (not shown in the drawing), the developing sleeve 13A is given an electric potential having the same polarity as the surface potential of the photoreceptor 10 (negative polarity, for example), and by this developing sleeve 13A, a developer containing toner particles charged in the same polarity as the electric potential of the developing sleeve 13A (negative polarity, for example) is conveyed to the developing region.

Thus, the surface potential of the unexposed area of the photoreceptor 10 (Vh), the surface potential of the exposed area of the photoreceptor 10 (Vl), and the potential of the developing sleeve (Vd) have the same polarity as one another, and the relation between their absolute values is expressed by Vh>Vd>Vl; hence, in the developing region, toner particles on the developing sleeve 13A are deposited on the exposed area, to perform a reverse development.

The toner image formed on the photoreceptor 10 is transferred to a recording material P, and the recording material P, having a toner image transferred on it, is detached from the surface of the photoreceptor 10 by the detaching device 15; then, it is subjected to a fixing process in a fixing device (not shown in the drawing).

On the other hand, by applying a bias voltage of a controlled magnitude to the cleaning roller 21 making up the cleaning device 20 by the bias voltage applying means 22, to make the roller charged in the reverse polarity to the residual toner particles on the photoreceptor 10 having passed the transfer region (positive polarity, for example), the residual toner particles on the photoreceptor 10 are removed by this cleaning roller 21, while the residual toner particles having passed through this cleaning roller 21 are removed mechanically by the cleaning blade 23.

Then, the toner particles removed by the cleaning device 20 are fed to the developing device 13 by the collecting transporting mechanism containing the collecting roller 25, to be utilized again.

Further, in the above-mentioned image forming apparatus, by using, for the toner for visualizing the electrostatic latent image formed on the photoreceptor 10 to form a toner image, a toner having a specified structure (particle diameter) of its own, that is, a specified toner composed of toner particles having their particle diameter made even, the expected cleaning effect by the cleaning roller 21 can be exhibited with certainty; hence, a high-quality image can be formed with certainty.

In the following, a toner to be used in this invention will be explained.

A toner to be used in this invention is such that has a number variation coefficient of 27% or smaller in the particle diameter distribution by number, and desirably it should be 25% or smaller. By making the number variation coefficient 27% or smaller, the vacant space in the toner layer (powder layer) transferred is decreased, which improves the fixing performance, and offset phenomenon is made difficult to occur. Further, the charge quantity distribution becomes sharper, which makes the transfer efficiency higher, and improves the image quality.

The particle diameter distribution by number and the number variation coefficient of a toner used in this invention are such ones that are measured by means of a Coulter counter TA-II or a Coulter multisizer (manufactured by Coulter Co., Ltd.). In this invention, a Coulter multisizer was used with an interface (manufactured by Nikkaki Co., Ltd.) and a personal computer connected. For the aperture used in the above-mentioned Coulter multisizer, one of 100 μm was used, and by measuring the volume and number of toner particles having the diameter of 2 μm or larger, the particle diameter distribution and the average particle diameter were calculated. The particle diameter distribution by number represents the relative frequency of toner particles vs. particle diameter, and the number-average particle diameter Dn represents the median diameter in the particle diameter distribution by number. The "number variation coefficient in the particle diameter distribution by number" of a toner is calculated by the following equation.

$$\text{number variation coefficient}=(S/Dn)\times 100\ (\%),$$

where S denotes the standard deviation in the particle diameter distribution by number, and Dn denotes the number-average particle diameter (μm).

As regards the method of controlling the number variation coefficient of a toner is not to be particularly limited. For example, a method in which toner particles are classified by the force of an air flow can be used, but in order to make the number variation coefficient smaller, classification in a liquid is effective. For this method of classifying toner particles in a liquid, it can be cited a method in which a centrifugal separator is used, and by controlling its number of revolutions, toner particles are classified and collected in accordance with the difference in the sedimentation velocity due to difference in the particle diameter of the toner particles.

In particular, in the case where a toner is produced by a suspension polymerization method, in order to make the number variation coefficient in the particle diameter distribution by number 27% or smaller, classifying operation is necessary. In a suspension polymerization method, it is necessary to disperse oil drops of polymerizable monomer to come to have the desired size as a toner particle in an aqueous medium before polymerization. That is, for large oil drops of polymerizable monomer, by repeating mechanical shearing operation by a homomixer, a homogenizer or the like, the oil drops are made small to a degree of the size of toner particles; however, by such a method based on a mechanical shearing, the particle diameter distribution by number of the oil drops obtained becomes broad, and finally, the particle diameter distribution of the toner particles to be obtained by polymerizing these becomes broad. For this reason, a classification operation is essential.

For a toner used in this invention, it is desirable to make the number-average particle diameter (Dn) 3 to 8 μm, more desirably, it should be 3.5 to 6.5 μm, and particularly more desirably, it should be 4 to 6 μm. In a manufacturing method to be described in detail later, the number-average particle diameter of a toner can be controlled by the concentration of the flocculating agent (salting-out agent), the amount of the organic solvent to be added, the time of fusion bonding, or the composition of the polymer.

By making the number-average particle diameter 3 to 8 μm, the amount of toner particles having an excessively large adhering force to the developer carrying member or a low adhering force in the developing process can be made smaller, and an excellent developing performance can be obtained stably over a long period of time, while the transfer efficiency is made higher, and the image quality of halftone parts, fine lines, and small dots are improved.

With the particle diameter of each toner particle denoted by D (μm), natural logarithm lnD taken for the abscissa, which is divided into a plurality of classes at intervals of 0.23, in a histogram showing the particle diameter distribution based on the number of particles, it is desirable that the sum (M) of the relative frequency of the toner particles contained in the highest-frequency class (m1), and the relative frequency of the toner particles contained in the class next highest to the above-mentioned highest class (m2) is not smaller than 70%.

By making the sum (M) of the relative frequency (m1) and the relative frequency (m2) not smaller than 70%, the variance of the particle diameter distribution of toner particles becomes small, by using said toner in an image forming process, the occurrence of selective development phenomenon can be suppressed with certainty.

In this invention, the above-mentioned histogram showing the particle diameter distribution based on the number of particles is a histogram showing a particle diameter distribution based on the number of particles in which natural logarithm lnD (D: particle diameter of each toner particle) is divided into a plurality of classes at intervals 0.23 (0 to 0.23; 0.23 to 0.46; 0.46 to 0.69; 0.69 to 0.92; 0.92 to 1.15; 1.15 to 1.38; 1.38 to 1.61; 1.61 to 1.84; 1.84 to 2.07; 2.07 to 2.30; 2.30 to 2.53; 2.53 to 2.76; - - - ), and this histogram is prepared by a particle diameter distribution analyzing program in a computer from the particle diameter data of a sample measured by a Coulter multisizer according to the conditions described below and sent to said computer through an I/O unit.

(Measurement Conditions)

1: Aperture: 100 μm

2: Sample preparation method: 50 to 100 ml of an electrolytic liquid (ISOTON R-11 (manufactured by Coulter Scientific Japan Co., Ltd.) with a suitable amount of surfactant (neutral detergent) added is stirred, and 10 to 20 mg of the measurement sample is added to this. By dispersion-processing this system for one minute in a ultrasonic dispersing machine, a sample is prepared.

Figure 12:
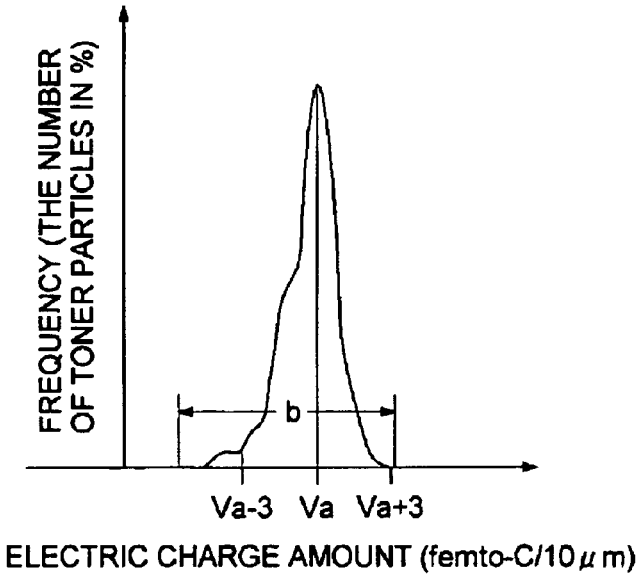
FIG. 12 is an explanatory drawing showing an example of charge quantity distribution of a toner to be used in this invention.

As regards a toner used in this invention, although it depends on the particle diameter of the toner particles, as shown in FIG. 12, in the charge quantity distribution based on the number of particles, the proportion of the toner particles having a charge quantity falling within a range of ±3 femto-C/10 μm with respect to the charge quantity Va at the highest frequency (peak) should be 70% or more, and desirably it should be 90% or more. By making this, by applying a bias voltage being controlled in accordance with the charge quantity of the toner particles, a proper cleaning effect by the cleaning roller 21 is secured. In addition, the charge quantity of a toner particle can be measured, for example, by an "E-SPART Analyzer" (manufactured by Hosokawa Micron Co., Ltd.), and "femto-C/10 μm" represents the charge quantity of a toner particle as it is converted into that of a toner particle having a particle diameter of 10 μm.

It is desirable that a toner to be used in this invention is one that is obtained at least by polymerizing a polymerizable monomer in an aqueous medium, or at least by associating resin particles in an aqueous medium.

Such a toner can be produced, for example, by a suspension polymerization method, or by a method in which a monomer is polymerized by emulsion polymerization in a liquid with an emulsified liquid of necessary additives added, to produce a fine polymer particles, and after that, the particles are associated by adding an organic solvent, a flocculating agent, etc. Further, it can be produced by a method in which association is made by mixing a monomer and a dispersion liquid of a releasing agent and a coloring agent which are necessary to the composition of a toner, a method in which emulsion polymerization is made after toner constituents such as a releasing agent, and a coloring agent are dispersed in a monomer, or the like. In addition, "association" means that a plurality of resin particles and a plurality of coloring agent particles are fused to be bonded to one another, including the case where one or more of said resin are fused to be bonded to one or more of another particles (coloring agent particles, for example).

Further, the term "an aqueous medium" used in this invention represents a medium containing water in an amount of at least 50% or more by weight.

To show an example of a method of producing such a toner, a coloring agent and, as occasion demands, various kinds of constituent such as a releasing agent, a charge controlling agent, and a polymerization initiator are added to a polymerizable monomer, and those various kinds of constituent are dissolved or dispersed in the polymerizable monomer by means of a homogenizer, a sand mill, a sand grinder, an ultrasonic dispersing machine, or the like. This polymerizable monomer having various kinds of constituent dissolved or dispersed in it is dispersed in an aqueous medium containing a dispersion stabilizer to become oil drops having the desired size as a toner by means of a homomixer, a homogenizer, or the like. After that, the dispersion liquid is transferred to a reaction apparatus equipped with a stirring mechanism, which is made up of stirring planes to be described later, and the polymerization reaction is made to proceed by heating. After the completion of the reaction, by removing the dispersion stabilizer, and filtering, washing, and drying the liquid, a toner is prepared.

Further, for a method of producing a toner, a method in which resin particles are associated or fused to be bonded to one another in an aqueous medium to prepare a toner can be cited. As regards this method, there is no particular limitation, and for example, methods shown in the publications of the unexamined patent application H5-265252, H6-329947, H9-15904 can be cited. That is, a toner is formed by a method in which a plurality of resin particles and dispersed particles of constituent material such as coloring agent or a plurality of fine particles composed of resin, coloring agent, etc. are associated; in particular, a toner is prepared by a method in which after these particles are dispersed in an aqueous medium by using an emulsifying agent, they are salted out by adding a flocculating agent with an amount of critical agglomeration concentration or more, while at the same time, fusion-bonded particles are being formed by fusion-bonding them to one another by heating at a temperature not lower than the glass transition temperature of the formed polymer itself, with their particle diameter being made to grow, and at the timing when they have the target particle diameter, the growth of particle diameter is stopped by adding a large amount of water; further the shape of the particles are controlled by smoothing the surface of the particles while the liquid being heated and stirred, and the particles are heated and dried as they are in a fluid state containing water (salting-out/fusion-bonding). In addition, in this case, it is also appropriate to add a solvent which can be dissolved infinitely in water at the same time as the flocculating agent.

For the polymerizable monomer to be used as one composing the resin, the following can be cited: styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene;

methacrylic ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethyl-aminoethyl methacrylate, and dimethyl-aminoethyl methacrylate;

acrylic ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate;

olefins such as ethylene, propylene, and isobutylene, vinyl or vinylidene halides such as vinyl chloride, vinylidene chloride, vinyl bromide, vinyl fluoride, and vinylidene fluoride, vinyl esters such as vinyl propionate, vinyl acetate, and vinyl benzoate, vinyl ethers such as vinylmethyl ether, and vinylethyl ether, vinyl ketones such as vinylmethyl ketone, vinylethyl ketone, and vinylhexyl ketone, N-vinyl compounds such as N-vinylcarbazole, N-vinyl indole, N-vinyl pyrrolidone, vinyl compounds such as vinyl naphthalene, and vinyl pyridine, acrylate or methacrylate derivatives such as acrylonitrile, methacrylonitrile, and acryl amide. These vinyl monomers can be used singly or in combination with one another.

Further, for the polymerizable monomer to compose the resin, it is more desirable to use ones having an ionic dissociable radical in combination with one another. For example, monomers having a substituent group such as a carboxil group, a sulfonic acid group, or a phosphate group, namely, acrylic acid, methacrylic acid, maleic acid, itaconic acid, cinnamic acid, fumaric acid, maleic acid monoalkyl ester, itaconic acid monoalkyl ester, styrenesulfonic acid, arylsulfosuccinic acid, 2-acrylamide-2-methylpropanesulfonic acid, acidphosphooxyethylmethacrylate, 3-chloro-2-acidphosphooxypropylmethacrylate, etc. can be cited.

Further, it is possible to make a resin having a bridge structure by using polyfunctional vinyl monomers such as divinyl benzene, ethyleneglycol dimethacrylate, diethyleneglycol dimethacrylate, diethyleneglycol diacrylate, triethyleneglycol dimethacrylate, triethyleneglycol diacrylate, neopentylglycol dimethacrylate, and neopentylglycol diacrylate.

These polymerizable monomers can be polymerized by using a radical polymerization initiator. In this case, an oil-soluble polymerization initiator can be used in a suspension polymerization method. For this oil-soluble polymerization initiator, the following can be cited: azo-group or diazo-group polymerization initiators such as 2,2'-azobis-(2,4-dimethylvaleronitrile), 2,2'-azobisisobutylonitrile, 1,1'-azibis(cyclohexane-1-carbonitrile), 2,2'-azobis-4-methoxy-2,4-dimethylvaleronitrile, and azobisisobutylonitrile; peroxide polymerization initiators such as benzoyl peroxide, methylethylketone peroxide, diisopropyl peroxicarbonate, cumene hydroperoxide, t-butyl hydroperoxide, di-t-butyl peroxide, dicumyl peroxide, 2,4-dichlorobenzoil peroxide, lauroyl peroxide, 2,2-bis-(4,4-t-butylperoxycyclohexil) propane, tris-(t-butylperoxi)triazine; and high-molecular polymerization initiator having a peroxide in a side chain.

Further, in the case where an emulsion polymerization method is used, a water-soluble radical polymerization initiator can be used. For the water-soluble polymerization initiator, persulfuric acid salt such as potassium persulfate, and ammonium persulfate, azobisaminodipropane acetate, azobiscyanovaleric acid and its salt, and hydrogen peroxide can be cited.

For the dispersion stabilizing agent, calcium tertiary phosphate ($Ca_3(PO_4)_2$), magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, etc. can be cited. Further, compounds which are generally used as surface active agents such as polyvinyl alcohol, gelatin, methylcellulose, sodium dodecylbenzenesufonate, an addition product of ethylene oxide, higher alcohol sodium sulfate can be used as a dispersion stabilizing agent.

For an excellent resin in this invention, one having a glass transition temperature of 20 to 90° C. is desirable, and one having a softening point of 80 to 220° C. is desirable. A glass transition temperature can be measured by a differential thermal analysis method, and a softening point can be measured by a drop-type flow tester. Further, for this resin, one having a molecular weight, which is measured by gel-permeation chromatography, falling within a range as a number-average molecular weight (Mn) of 1,000 to 100,000 and as a weight-average molecular weight (Mw) of 2,000 to 1,000,000 is desirable. Further, in respect of molecular weight distribution, a resin having the ratio Mw/Mn from 1.5 to 100 is desirable, and in particular, the ratio from 1.8 to 70 is more desirable.

For the flocculating agent to be used in the case where the above-mentioned resin particles are made to associate one another in an aqueous medium, there is no particular limitation, and one selected from the group of metallic salts can be properly used. To state it concretely, salts of an alkaline metal as a monovalent metal, for example, sodium, potassium, lithium, etc., and salts of an alkaline earth metal as a bivalent metal, for example, calcium, magnesium, etc., salts of bivalent metal such as manganese and copper, and salts of trivalent metal such as iron and aluminum can be cited; for concrete names of the salt, sodium chloride, potassium chloride, lithium chloride, calcium chloride, zinc chloride, copper sulfide, magnesium sulfide, manganese sulfide, etc. can be cited. These may be used in combination.

It is desirable that these flocculating agent is added in an amount of critical flocculating concentration or more. This critical flocculating concentration is an index concerning the stability of the aqueous dispersion, and represents the concentration at which flocculation is produced by the addition of the flocculating agent. This critical flocculating concentration varies remarkably in accordance with the component and the dispersing agent itself. For example, it is described in detail in 'Seizo Okamura et al: "High Molecular Chemistry, 17, 601 (1960)" edited by The Society of Polymer Science, Japan' etc., detailed critical flocculating concentration can be obtained. Further, as another method, a critical flocculating concentration can be also obtained as the salt concentration to make the ζ potential of the target particle dispersion liquid change in the case where the desired salt is added in it while its concentration is being varied and the ζ potential is being measured.

It is appropriate if the amount of addition of the flocculating agent is equivalent to the critical flocculating concentration or more, and desirably it should be added in an amount equivalent to 1.2 times or more of the critical flocculating concentration, and more desirably 1.5 times or more.

For the "solvent being infinitely soluble in water" to be used with the flocculating agent, one that does not dissolve the resin to be formed is selected. To state it concretely, alcohols such as methanol, ethanol, propanol, isopropanol, t-butanol, methoxyethanol, or butoxyethanol, nitrites such as acetonitrile, and ethers such as dioxan can be cited. In particular, ethanol, propanol, and isopropanol are desirable.

It is desirable that the amount of addition of this solvent being infinitely soluble in water is 1 to 100% by volume to the dispersion liquid containing the polymer with the flocculating agent added.

A toner to be used in this invention contains at least resin and a coloring agent, but it is possible that the toner contains also a releasing agent which is a fixing performance improving agent, a charge controlling agent, etc as occasion demands. Further, it may be such one that consists of toner particles mainly composed of the above-mentioned resin and coloring agent with an external additive composed of inorganic fine particles, organic fine particles or the like added externally.

For the coloring agent to be used in a toner of this invention, carbon black, magnetic substance, dye, pigment, etc. can be arbitrarily used; for the carbon black, channel black, furnace black, acetylene black, thermal black, lampblack, etc. can be used. For the magnetic substance, ferromagnetic metals such as iron, nickel, cobalt, alloys containing these metals, ferrimagnetic compounds such as ferrite, magnetite, alloys not containing a ferromagnetic metal but exhibiting ferromagnetic property by heat treatment, for example, an alloy of a kind called a Heusler's alloy such as manganese-copper-aluminum or manganese-copper-tin, chromium dioxide, etc. can be used.

For the dye, C. I. solvent red 1, C. I. solvent red 49, C. I. solvent red 52, C. I. solvent red 58, C. I. solvent red 63, C. I. solvent red 111, C. I. solvent red 122, C. I. solvent yellow 19, C. I. solvent yellow 44, C. I. solvent yellow 77, C. I. solvent yellow 79, C. I. solvent yellow 81, C. I. solvent yellow 82, C. I. solvent yellow 93, C. I. solvent yellow 98, C. I. solvent yellow 103, C. I. solvent yellow 104, C. I. solvent yellow 112, C. I. solvent yellow 162, C. I. solvent blue 25, C. I. solvent blue 36, C. I. solvent blue 60, C. I. solvent blue 70, C. I. solvent blue 93, C. I. solvent blue 95, etc. can be used, and moreover, a mixture of these can be also used. For the pigment, C. I. pigment red 5, C. I. pigment red 48:1, C. I. pigment red 53:1, C. I. pigment red 57:1, C. I. pigment red 122, C. I. pigment red 139, C. I. pigment red 144, C. I. pigment red 149, C. I. pigment red 166, C. I. pigment red 177, C. I. pigment red 178, C. I. pigment red 222, C. I. pigment orange 31, C. I. pigment orange 43, C. I. pigment yellow 14, C. I. pigment yellow 17, C. I. pigment yellow 93, C. I. pigment yellow 94, C. I. pigment yellow 138, C. I. pigment green 7, C. I. pigment blue 15:3, C. I.

pigment blue 60, etc. can be cited. The mixture of these can be used also as a mixture. The number-average primary particle diameter of the coloring agent is diversified in accordance with the kind, and generally speaking, 10 to 200 nm is desirable.

For the method of adding a coloring agent, it can be used a method in which the coloring agent is added at the stage when the polymer particles prepared by an emulsion polymerization method is made to agglomerate by adding a flocculating agent to color the polymer particles, or a method in which a coloring agent is added in the stage of polymerizing the monomer, to make colored particles when polymerization is finished. In addition, in the case where a coloring agent is added in the stage to prepare a polymer, it is desirable to use it after the surface of the coloring agent particles is treated by a coupling agent in order that the radical polymerization function of the monomer may not be hindered by the coloring agent.

Further, it is also appropriate to add low molecular weight polypropylene (the number-average molecular weight=1,500 to 9,000) or low molecular weight polyethylene, etc. as a fixing performance improving agent.

In the same way for the charge control agent too, several kinds of the agents which are known to public and can be dispersed in water can be used. To state it concretely, a dye belonging to the Nigrosine group, metal salt of naphthenic acid or higher fatty acid, alkoxylamine, quaternary ammonium salt compound, metal complex belonging to azo-group, metal salt of salicilic acid or its metal complex, etc. can be cited.

Besides, it is desirable that the particles of these charge control agents and fixing performance improving agents have number-average primary particle diameter of 10 to 500 nm in a dispersed state.

As regards a toner to be used in this invention, by using it with inorganic fine particles or organic fine particles added as an external additive, it can exhibit a greater effect. As the reason of this, it is presumed that the effect becomes remarkable because the embedding or detachment of the external additive particle can be effectively prevented.

For the above-mentioned inorganic fine particles, it is desirable to use particles of inorganic oxide such as silica, titania, and alumina, and further, it is desirable that these inorganic fine particles are subjected to a hydrophobic-making treatment. For the degree of the hydrophobic-making treatment, there is no particular limitation, but it is desirable to make the particles have a methanol wettability of 40 to 95. The term "methanol wettability" means an index for evaluating the wettability to methanol. To state this method, in a distilled water contained in a beaker having a capacity of 200 ml, inorganic fine particles as the object of measurement, which have been weighed to have a weight of 0.2 g, are added. Methanol is slowly dropped down from a burette whose end is dipped in the water in a state of the water being slowly stirred until the whole of the inorganic fine particles are wetted. With this amount of methanol required for completely wetting the inorganic fine particles denoted by a (ml), the degree of hydrophobic-making is calculated from the following equation.

$$\text{Degree of hydrophobic-making}=(a/(a+50))\times 100.$$

The amount of addition of this external additive is 0.1 to 5.0% by weight in the toner, and desirably 0.5 to 4.0% by weight. Further, for the external additive, a combination of various kinds of it may be also used.

In a toner to be used in this invention, it is possible to make the distribution of the shape of the toner particles controlled.

For example, in what is called a suspension polymerization toner, which is obtained by suspending particles of polymerizable monomer with toner constituents such as a coloring agent dissolved or dispersed in it in an aqueous medium, and polymerizing them, the shape of the toner particles can be controlled by controlling the flow of the medium in the reaction vessel in which the polymerization reaction is performed. That is, in the case where the flow of the medium in the reaction vessel is made turbulent, at the timing when the oil drops, which are present in the aqueous medium in a state of suspension with the proceeding of polymerization, are gradually made high molecular to become soft particles, the uniting of the particles is accelerated by making the collision of the particles, and particles having an indefinite shape are obtained; further, in the case where the flow of the medium in the reaction vessel is made laminar, sphere-shaped particles can be obtained by avoiding the collision of the particles.

As the result of a further diligent investigation, the inventors of this invention found that the charge quantity distribution became sharp in the case where the shape of the toner particles was made even. That is, it was found that, also by using a toner composed of toner particles including those in an amount of 65% by number or more which had a shape coefficient falling within a range of 1.2 to 1.6, and had a variation coefficient of the shape coefficient of 16% or under, an image, which was excellent in the developing performance of solid areas and the reproducibility of fine lines and had a high image quality, could be stably formed over a long period of time.

The shape coefficient of a toner of this invention is such one that is expressed by the equation described below, and represents the degree of roundness of a toner particle.

$$\text{Shape coefficient}=(((\text{maximum diameter})/2)^2\times\pi)/(\text{projection area}),$$

where the maximum diameter means the width of a particle expressed by the maximum value of the interval of a pair of parallel lines drawn in contact with the circumference of the projection image of a toner particle on a plane placed in between, when the position of the pair of parallel lines is changed along over the whole circumference. Further, the projection area means the area of the projection image of a toner particle on a plane.

In this invention, this shape coefficient was measured by practicing the analysis of a photographic image by means of a "SCANNING IMAGE ANALYZER" (manufactured by JEOL, Ltd.) on the basis of an enlarged photograph of a toner particle which was taken by a scanning electron microscope of 2000 magnifications. At this time, 100 toner particles were used, and the shape coefficient of this invention was calculated on the basis of the above-mentioned equation.

In the present invention, toner contains toner particles which have a value of this shape coefficient falling within a range of 1.0 to 1.6 in amount of not less than 65% by number, preferably not less than 70% by number, is used. Further, toner contains toner particles which have a value of this shape coefficient falling within a range of 1.2 to 1.6 in amount of not less than 65% by number, preferably not less than 70% by number, is used.

By making the proportion of toner particles which have a value of this shape coefficient falling within a range of 1.2 to 1.6 not less than 65% by number, the frictional charging ability with the toner carrying member (carrier) is made more uniform, the accumulation of toner particles excessively charged can be reduced, and the carrying of toner particles by the toner carrying member can be more smoothly performed; therefore, the problems of ghost images in development etc. become difficult to occur. Further, toner particles become hard to break, which reduces contamination of the charge giving member and stabilizes the charging ability of the toner.

The method of controlling this shape coefficient is not particularly limited. For example, there is a method in which it is adjusted by adding toner particles having a shape coefficient falling within a range of 1.2 to 1.6, which are prepared by a method in which toner particles are jetted into a heated air flow, a method in which toner particles are repeatedly given a mechanical energy by an impact force in a gas phase, a method in which toner particles are added in a solvent which does not dissolve the toner particles to be involved in a whirling flow, or the like, in usual toner particles with an amount to make the toner come within the scope of this invention. Further, there is a method in which it is adjusted by adding toner particles, whose coefficient of shape is adjusted to have a value falling within a range of 1.2 to 1.6 by controlling the shape of the whole in the stage of preparing the toner particles by what is called a polymerization method, in usual toner particles in the same way.

Among toners manufactured by any one of the above-mentioned manufacturing methods, a toner manufactured by a polymerization method is desirable for the reasons that the manufacturing method is simple, that the toner particles have an excellent surface uniformity as compared to toner particles produced by a pulverization method.

The variation coefficient of the shape coefficient to be desirably used in this invention is calculated from the equation described below.

$$\text{Variation coefficient}=(S/K)\times 100(\%).$$

In the above equation, S denotes the standard deviation of the shape coefficient of 100 toner particles, and K denotes the mean value of the shape coefficient values.

In a toner to be used in this invention, this variation coefficient of the shape coefficient should be not greater than 16%, and desirably should be not greater than 14%. By making the variation coefficient of the shape coefficient not greater than 16%, vacant spaces in the toner layer transferred are reduced, which improves the fixing performance, and makes offset hard to occur. Further, the charge quantity distribution becomes sharp, and the image quality is improved.

In order to control this shape coefficient of a toner and the variation coefficient of the shape coefficient to be extremely uniform without variation depending on the manufacturing lot, also it is appropriate to determine a proper process termination timing while the monitoring of the characteristics of toner particles (colored particles) in process of formation is carried out, in the process in which the resin particles (polymer particles) are polymerized, fused to be bonded to one another, and their shape is controlled.

The term "monitoring" means to practice a control of process conditions on the basis of the result of measurement by means of a measurement apparatus built in the production line. That is, the measurement of shape etc. is incorporated in the production line, for example in the case of toner particles produced by a polymerization method, which are formed by making resin particles associated or fusion-bonded to one another in an aqueous medium, the shape and particle diameter are measured while sampling is successively practiced in the process of fusion-bonding, etc., and the reaction is stopped at the timing when the desired shape is obtained.

As regards the method of monitoring, there is no particular limitation; it is possible to use a flow-type particle image analyzing apparatus FPIA-2000 (manufactured by Toa Iyo Denshi Corp.). This apparatus is suitable because it can make monitoring by carrying out image processing in real time with the sample liquid made to pass. That is, monitoring is always carried out through taking sample liquid from the reaction field by using a pump or the like, to practice measurement of shape etc., and the reaction is stopped at the timing when the desired shape is obtained.

As regards a toner produced by what is called a suspension polymerization method in which a toner is obtained by suspending polymerizable monomer particles with toner constituents such as a coloring agent dispersed or dissolved internally in an aqueous medium, and successively polymerizing the particles, it is possible to control the shape of the toner particles by controlling the flow of the medium in the reaction vessel for practicing the polymerization reaction. That is, in the case where toner particles having a shape corresponding to the shape coefficient not smaller than 1.2 should be produced in larger amount, the flow of the medium in the reaction vessel is made turbulent, and at the timing when the oil drops become soft particles through it that the oil drops being present in the aqueous medium in a state of suspension become gradually high molecular with the proceeding of polymerization, the uniting of the particles are accelerated by making the collision of the particles, which gives particles having an indefinite shape. Further, in the case where sphere-shaped toner particles having the shape coefficient smaller than 1.2 should be formed, by making the flow of the medium in the reaction vessel laminar, and avoiding the collision of the particles, sphere-shaped particles are obtained. By this method, the distribution of the shape of a toner can be controlled to become within the scope of this invention. In the following, a reaction apparatus to be desirably used will be described.

Figure 3:
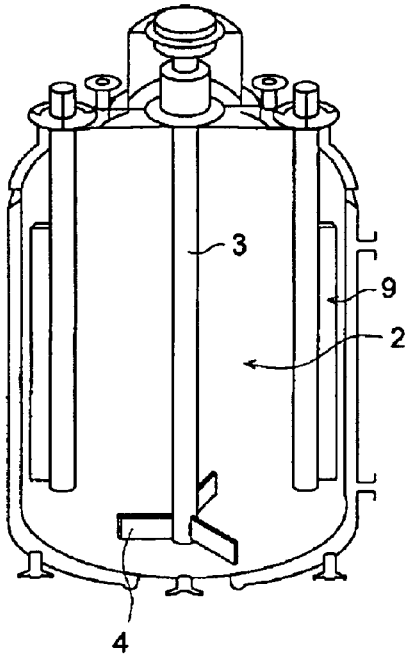
FIG. 3 is an explanatory drawing showing a reaction apparatus having one-stage structure of its stirring planes.

FIG. 3 is an explanatory drawing showing a reaction apparatus (stirring apparatus) having a one-stage structure of the stirring planes which is generally used; 2 denotes a stirring tank, 3 denotes a rotary shaft, 4 denotes stirring planes, and 9 denotes turbulent flow forming members.

In a suspension polymerization method, a turbulent flow can be formed by using specified stirring planes, and the toner particles are controlled to have an indefinite shape. The reason for this is not certain, but in the case where the structure of the stirring planes fitted to the rotary shaft 3 shown in FIG. 3 is of one stage, which are generally used, the flow of the medium formed in the stirring tank 2 consists of only the flow moving along the wall surface which extends from the lower part to the upper part of the stirring tank 2. Therefore, it has heretofore been put in practice that, generally by arranging a turbulent flow forming member 9 at a position near to the wall surface of the stirring tank 2, a turbulent flow was formed, and the efficiency of the stirring was enhanced. However, by the above-mentioned structure of the apparatus, although a turbulent flow is partly formed, it rather acts in such a way as to make the flow of the fluid tend to be standing due to the presence of the turbulent flow, and as the result, because the shearing force to the particles becomes weaker, their shape cannot be controlled.

A reaction apparatus equipped with stirring planes which can be desirably used in a suspension polymerization method will be explained by using the drawings.

Figure 4:
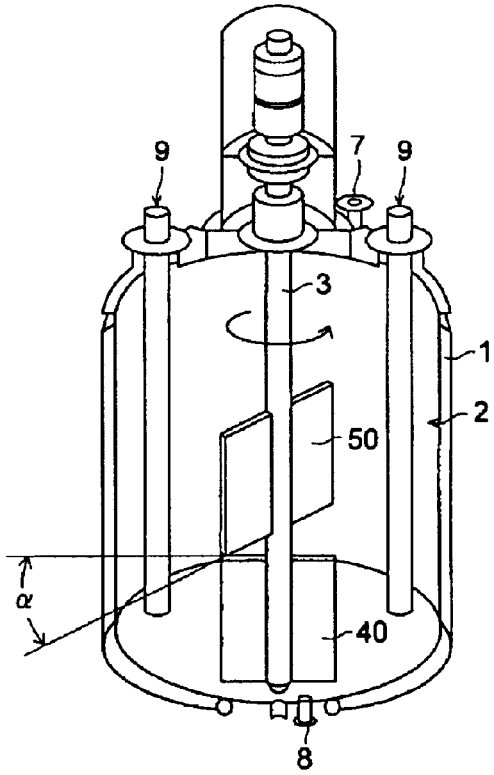
FIG. 4 is a perspective view showing an example of a reaction apparatus equipped with stirring planes which can be desirably used.
Figure 5:
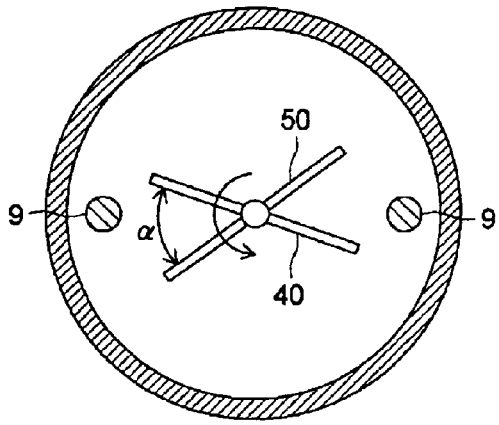
FIG. 5 is a cross-sectional view of the reaction apparatus shown in FIG. 4.

FIG. 4 and FIG. 5 are a perspective view and a cross-sectional view respectively both showing an example of such a reaction apparatus. In the reaction apparatus shown in FIG. 4 and FIG. 5, a rotary shaft 3 is mounted vertically at the central part of a vertical cylindrical stirring tank 2 with a jacket 1 for heat exchange mounted on the outer circumference portion of the stirring tank, and a stirring plane 40 mounted to the rotary shaft 3 close to the bottom surface of the stirring tank 2 and a stirring plane 50 mounted to the shaft at an upper position of this stirring plane 40 are provided. The upper stirring plane 50 is arranged in such a way as to make a crossing angle α preceding in the rotating direction with the stirring plane positioned at the lower stage. In the case where a toner of this invention is produced, it is desirable to make the crossing angle α smaller than 90°. Although there is no lower limitation for this crossing angle α, it is desirable that it is not smaller than about 5°, and more desirably, it should be not smaller than 10°. In addition, in the case where stirring planes having a three-stage structure are provided, it is desirable that the crossing angle between any stirring plane and its neighboring stirring plane is smaller than 90°.

By making the structure like this, the following process is presumed. That is, the medium is stirred by the stirring plane 50 arranged at the upper stage first, which forms a downward flow. Subsequently, by the stirring plane 40 arranged at the lower stage, the flow having been formed by the upper-stage stirring plane 50 is accelerated further downward, while another flow is separately formed by the upper-stage stirring plane 50 itself, the flow as a whole is accelerated and proceeds. It is presumed that, as the result of this, because a flow region having a large shearing force formed as a turbulent flow is formed, the shape of the toner particles to be obtained can be controlled.

Besides, in FIG. 4 and FIG. 5, the arrow marks show the direction of rotation, and 7 denotes an upper inlet for introducing material, 8 denotes a lower inlet for introducing material, 9 denotes a turbulent flow forming member for making stirring effective.

In the above, as regards the shape of the stirring planes, there is no particular limitation; quadrangular-shaped plate, one having a notch at a part of the plane, one having one or more through holes, so called slits, at the central part of each half plane, etc. can be used. Concrete examples of these are noted in FIG. 6(*a*) to FIG. 6(*d*). The stirring plane 5*a* shown in FIG. 6(*a*) is one having no through hole portion, the stirring plane 5*b* shown in FIG. 6(*b*) is one having a large through hole portion 6*b* at the center of each half plane, the stirring plane 5*c* shown in FIG. 6(*c*) is one having a through hole portion composed of two slits which are laterally long in each half plane, and the stirring plane 5*d* shown in FIG. 6(*d*) is one having a through hole portion composed of two slits which are vertically long in each half plane. Further, in the case where stirring planes having a three-stage structure are provided, the through hole portion formed in the upper-stage stirring plane and the through hole portion formed in the lower-stage stirring plane may have different shapes respectively or may have the same shape.

FIG. 7 to FIG. 10 are perspective views each of which shows a concrete example of a reaction apparatus provided with stirring planes which can be desirably used. In FIG. 7 to FIG. 10, 1 denotes a jacket for heat exchange, 2 denotes a stirring tank, 3 denotes a rotary shaft, and 9 denotes turbulent flow forming members.

Figure 7:
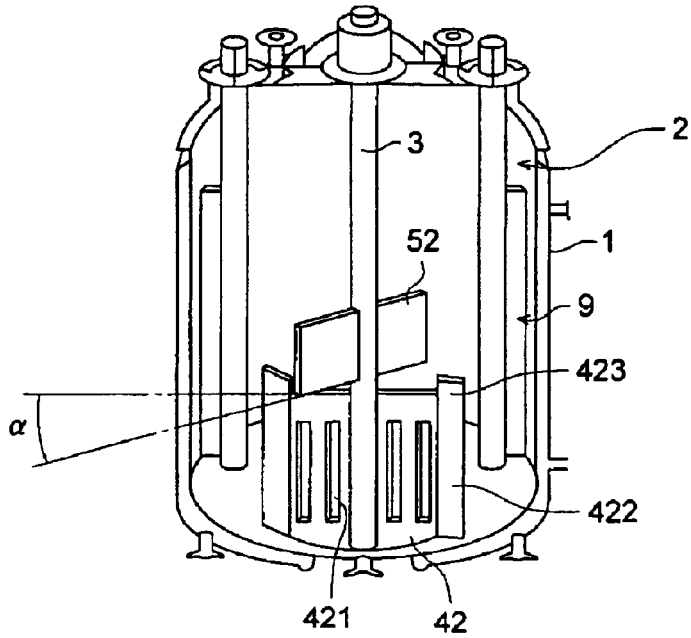
FIG. 7 is a perspective view showing a concrete example of a reaction apparatus equipped with stirring planes which can be desirably used.

In the reaction apparatus shown in FIG. 7, the lower-stage plane 42 have a structure such that each half plane has, for example, two slits formed at the center, to make the total four slits 421, and has a bent portion 422 and a fin 423 formed at each end of the half plane. The upper-stage plane 52 have a structure having the same shape as that of the stirring plane 50 making up the reaction apparatus shown in FIG. 4.

Figure 8:
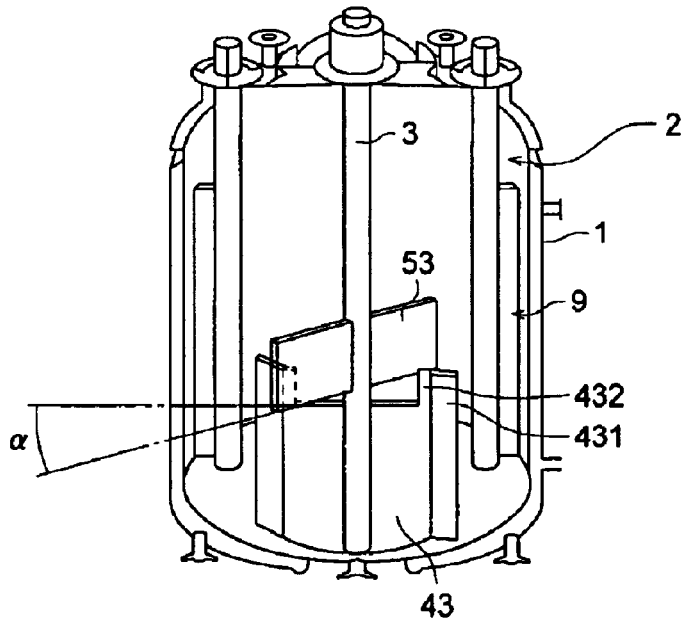
FIG. 8 is a perspective view showing another concrete example of a reaction apparatus equipped with stirring planes which can be desirably used.

In the reaction apparatus shown in FIG. 8, the lower-stage plane 43 have a structure such that each half plane has a bent portion 431 and a fin 432 formed at each end. The upper-stage plane 53 have a structure having the same shape as that of the stirring plane 50 making up the reaction apparatus shown in FIG. 4.

Figure 9:
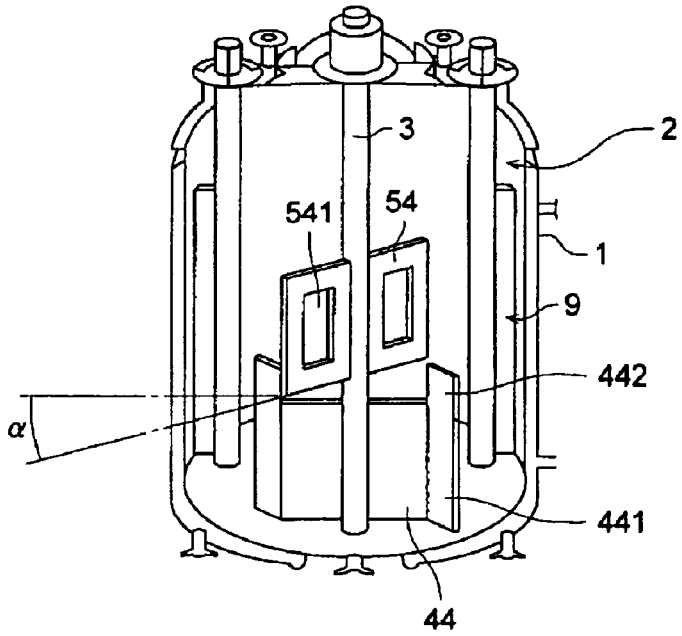
FIG. 9 is a perspective view showing a further another concrete example of a reaction apparatus equipped with stirring planes which can be desirably used.

In the reaction apparatus shown in FIG. 9, the lower-stage plane 44 have a structure such that each half plane has a bent portion 441 and a fin 442 formed at each end. The upper-stage plane 54 have a structure such that each half plane has a through hole portion 541 formed at the center.

Figure 10:
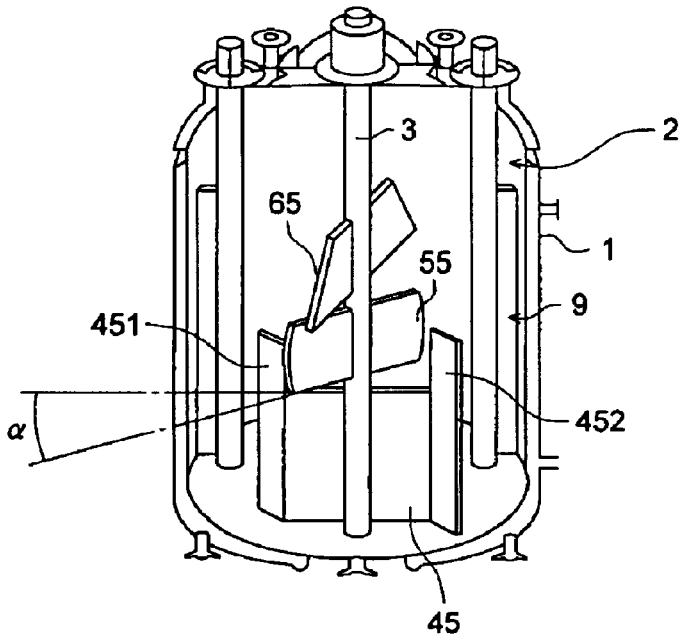
FIG. 10 is a perspective view showing a further another concrete example of a reaction apparatus equipped with stirring planes which can be desirably used.

In the reaction apparatus shown in FIG. 10, a three-stage structure provided with the lower-stage stirring plane 45, the middle-stage stirring plane 55, and the upper-stage stirring plane 65, and at the both ends of the lower-stage stirring plane 45, a bent portion 451 and a fin 452 are formed.

Besides, in the case where a bent portion is formed at the ends of the stirring plane, it is desirable that the angle of bending is 5 to 45°.

The stirring plane having a structure provided with these bent portions having protrusions (fins) to the upper side or lower side generate a turbulent flow effectively in the stirring tank.

In addition, as regards the clearance between the upper-stage stirring plane and the lower-stage stirring plane, there is no particular limitation, but it is desirable at least a clearance is provided between the upper and lower stirring planes. The reason for this is not certain, but it can be considered that the efficiency of stirring is improved because a flow of the medium is formed through the clearance. In addition, it is desirable that the clearance has a width of 0.5 to 50% to the height of the liquid surface in a still-standing state, and more desirably it should have a width of 1 to 30% to that height.

Further, as regards the size of the stirring planes, there is no particular limitation, but it is desirable that the total sum of the height of all the stirring planes is 50% to 100% to the height of the liquid surface in a still-standing state, and more desirably, it should be 60 to 95% to that height.

Figure 11:
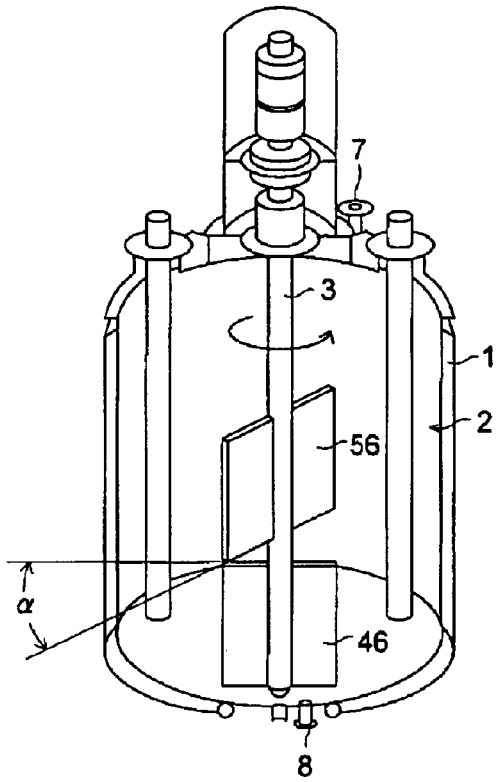
FIG. 11 is a perspective view showing an example of a reaction apparatus which can be desirably used in the case where a laminar flow is to be formed.

Further, it is shown in FIG. 11 an example of a reaction apparatus which is used in the case where a laminar flow is formed in a suspension polymerization method. This reaction apparatus is characterized by it that there is no turbulent flow forming member (obstructing member such as a hindering plate) provided in it.

The stirring plane 46 and the stirring plane 56 have the same shape and the crossing angle α as the stirring plane 40 and the stirring plane 50 making up the reaction apparatus shown in FIG. 4 respectively. Further, in FIG. 11, 1 denotes a jacket for heat exchange, 2 denotes a stirring tank, 3 denotes a rotary shaft, 7 denotes an upper inlet for introducing material, 8 denotes a lower inlet for introducing material.

Besides, as regards a reaction apparatus to be used in the case where a laminar flow is formed, it should not be limited to the apparatus shown in FIG. 11.

Further, as regards the shape of the stirring planes making up such a reaction apparatus, it is not limited to a particular one and any one can be used so long as it does not generate a turbulent flow. A stirring plane having a shape formed by a continuous surface such as a quadrangular-shaped plate is desirable, and it may have a curved surface.

On the other hand, as regards a toner produced by a polymerization method in which resin particles are associated or fusion-bonded to one another in an aqueous medium, by controlling the flow and temperature distribution of the medium in the reaction vessel at the stage of fusion-bonding, further by controlling the heating temperature, the number of revolutions of stirring, and the time in the shape controlling process after fusion-bonding, the shape distribution and the shape of toner particles as a whole can be arbitrarily changed.

That is, as regards a toner produced by a polymerization method in which resin particles are associated or fusion-bonded to one another in an aqueous medium, by using stirring planes and a stirring tank capable of making the flow in the reaction apparatus laminar and the temperature distribution of the inside uniform, and controlling the temperature, the number of revolutions, and the time in the fusion-bonding process and the shape controlling process, a toner having a uniform shape distribution can be formed. The reason of this is presumed in the following way. If fusion-bonding is made in a field where a laminar flow is formed, a strong stress does not act on the particles being subjected to proceeding flocculation and fusion-bonding (particles in process of association or flocculation), and in the laminar flow with its flow speed accelerated, the temperature distribution in the stirring tank is uniform. As the result of this, the shape distribution of the fusion-bonded particles becomes uniform. Further, by the heating and stirring in the shape controlling process after that, the fusion-bonded particles are gradually made spherical, and the shape of the toner particles can be arbitrarily controlled.

For the stirring planes and the stirring tank to be used in producing a toner by a polymerization method in which resin particles are associated or fusion-bonded to one another, those can be used which are the same as ones used in the case where a laminar flow is formed in the above-mentioned suspension polymerization method; for example, those which are shown in FIG. 11 can be used. The feature is that there is not provided an obstructing member such as a hindering plate which causes a turbulent flow to be formed. As regards the structure of the stirring planes, it is desirable to make them have a multi-stage structure having, in the same way as the stirring planes used in the above-mentioned suspension polymerization method, the upper-stage stirring plane making a crossing angle $\alpha$ preceding in the rotating direction with the lower-stage stirring plane provided.

As regards also the shape of these stirring planes, it can be employed the same one as that employed in the case where a laminar flow is formed in the above-mentioned suspension polymerization method, and there is no particular limitation so long as it does not cause a turbulent flow to be formed. A stirring plane having a shape formed by a continuous surface such as a quadrangular-shaped plate is desirable, and it may have a curved surface.

As regards a toner to be used in this invention, for example, a case where it is used as a magnetic toner for a single component developer with the particles made to contain a magnetic substance, a case where it is used as a toner in a two-component developer by being mixed with what is called a carrier, a case where it is used singly as a non-magnetic toner, etc. can be considered; in any case, it can be appropriately used.

It is desirable that the carrier particles which can be used in a two-component developer have a volume-average particle diameter of 15 to 100 $\mu$m, and more desirably, it should be 25 to 60 $\mu$m. As regards the measurement of the volume-average particle diameter of carrier particles, typically it can be measured by means of a particle diameter distribution measuring apparatus of a laser diffraction type equipped with a wet-type dispersing machine "HELOS" (manufactured by SYMPATEC Corp.).

For the carrier, one composed of carrier particles coated by resin, or what is called resin-dispersion-type carrier consisting of carrier particles which are composed of fine magnetic particles dispersed in resin is desirable. As regards the resin component for coating, there is no particular limitation; for example, olefin resin, styrene resin, styrene/acrylic resin, silicone resin, ester resin, fluorine-contained polymer resin, or the like can be used. Further, for resin to compose resin-dispersion-type carrier particles, there is no particular limitation and any one known to public can be used; for example, styrene/acrylic resin, polyester resin, fluorine-contained resin, phenol resin, etc. can be used.

The developing method in which a toner to be used in this invention can be used is not limited to a particular one; it may be a contact developing method in which development is carried out in a state that the surface of the photoreceptor 10 is brought in contact with the developer layer in the developing region, or a non-contact developing method in which development is carried out in a state that the surface of the photoreceptor 10 is kept in non-contact with the developer layer, and by making toner particles fly in the clearance between the surface of the photoreceptor 10 and the developer layer by the action of an alternating electric field etc.

Up to now, explanation has been made for the cases where this invention is applied to a monochromatic image forming apparatus, but this invention can be applied to a color image forming apparatus.

In this case, by using a toner composed of toner particles having the particle diameter made even for each color toner, the charging ability of the toner particles of each color toner can be made uniform over the whole particles. As the result of that, a stable developing performance can be obtained, while the cleaning effect by the cleaning roller can be exhibited with certainty; hence, a high-quality image which is excellent in color reproducibility, fine line reproducibility, etc. can be stably formed over a long period of time.

EXAMPLES OF PRACTICE

In the following, examples of practice of this invention will be explained, but this invention is not to be limited to these examples of practice. In addition, the term "part" used below means "part by weight".

Example of Toner Production 1

Example of Emulsion Polymerization Method Employing Association Process 0.90 kg of sodium n-dodecilsulfate was put in 10.0 liter (L) of pure water and stirred to dissolve. In this solution, 1.20 kg of carbon black REGAL 330R (manufactured by Cabot Corp.) was added gradually, and after it was stirred well for an hour, using a sand grinder (a medium-type dispersion machine), dispersion process was carried out continuously for 20 hours. This is referred to as "coloring agent dispersion liquid 1". Further, a solution composed of 0.055 kg of sodium dodecylbenzenesulfonate and 4.0 L of ion-exchange water was prepared and this is referred to as "anion surfactant solution A".

A solution composed of 0.014 kg of an addition product of 10 mol nonylphenol polyethylene oxide and 4.0 L of ion-exchange water was prepared and this is referred to as "nonion surfactant solution B". A solution composed of 223.8 g of potassium persulfate dissolved in 12.0 L of ion-exchange water was prepared and this is referred to as "initiator solution C".

3.41 kg of WAX emulsion (polypropylene emulsion having a number-average molecular weight of 3000, a number-average primary particle diameter of 120 nm, and a concentration of solid constituent of 29.9%), the whole amount of the "anion surfactant solution A", and the whole amount of the "nonion surfactant solution B were put in a glass-lined (GL) reaction pot having a capacity of 100 L equipped with a temperature sensor, a cooling tube, and a nitrogen introducing device (equipped with the stirring planes having the structure shown in FIG. 11, and the crossing angle α 20°), and stirring was started. Subsequently, 44.0 L of ion-exchange water was added.

Next, heating was started, and when the temperature of the liquid became 75° C., the whole amount of the "initiator solution C" was added by dropping it down. After that, while the temperature was controlled at 75° C.±1° C., a solution previously prepared by mixing 12.1 kg of styrene, 2.88 kg of n-butylacrylate, 1.04 kg of methacrylic acid, and 548 g of t-dodecylmercaptan was introduced as being dropped down. After the completion of dropping, the liquid temperature was raised to 80° C.±1° C., and heating and stirring was carried out for 6 hours. Subsequently, the liquid temperature was lowered to 40° C. or under, stirring was stopped, and the liquid was filtered by a pore-filter to give a latex, which is referred to as "latex-A".

Besides, as regards the resin particles in the "latex-A", the glass transition temperature was 57° C., the softening point was 121° C., the molecular weight distribution was such that the weight-average molecular weight was 12.7 thousands, and the weight-average particle diameter was 120 nm.

A solution composed of 0.055 kg of sodium dodecylbenzenesufonate dissolved in 4.0 L of ion-exchange pure water was prepared, to be referred to as "anion surfactant solution D".

Further, a solution composed of 0.014 kg of an addition product of 10 mol nonylphenol polyethylene oxide dissolved in 4.0 L of ion-exchange water was prepared, to be referred to as "nonion surfactant solution E".

A solution composed of 200.7 g of potassium persulfate (manufactured by Kanto Chemical Co., Ltd.) dissolved in 12.0 L of ion-exchange water was prepared, to be referred to as "initiator solution F".

Figure 6:
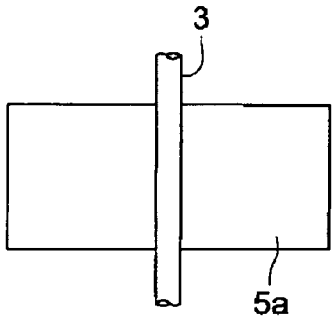
FIG. 6(*a*) to FIG. 6(*d*) are outline drawings showing concrete examples of the shape of the stirring planes.
Figure 6:
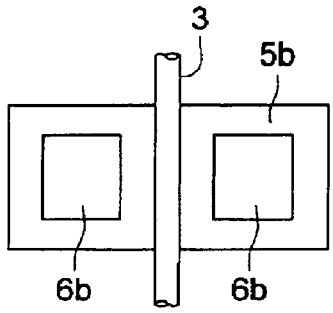
Figure 6:
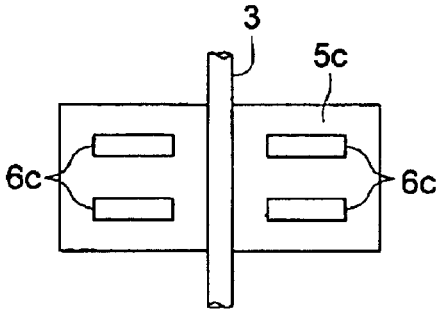
Figure 6:
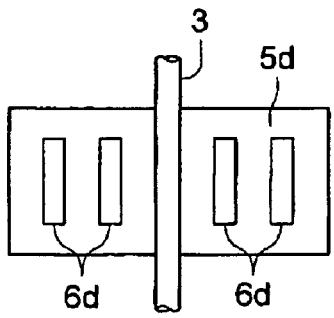

3.41 kg of WAX emulsion (polypropylene emulsion having a number-average molecular weight of 3000, a number-average primary particle diameter of 120 nm, and a concentration of solid constituent of 29.9%), the whole amount of the "anion surfactant solution D", and the whole amount of the "nonion surfactant solution E were put in a glass-lined (GL) reaction pot having a capacity of 100 L equipped with a temperature sensor, a cooling tube, a nitrogen introducing device, and a comb-shaped baffle (equipped with the stirring planes having the structure shown in FIG. 6(*a*)), and stirring was started.

Subsequently, 44.0 L of ion-exchange water was added. Heating was started, and when the temperature rose to 70° C., the "initiator solution F" was added. Next, a solution prepared by previously mixing 11.0 kg of styrene, 4.00 kg of n-butylacrylate, 1.04 kg of methacrylic acid, and 9.02 g of t-dodecylmercaptan was dropped down. After the completion of dropping down, heating and stirring were carried out for 6 hours with the liquid temperature controlled at 72° C.±2° C.; then, the liquid temperature was raised to 80° C.±2° C., and heating and stirring was carried out for 12 hours. Subsequently, the liquid temperature was lowered to 40° C. or under and stirring was stopped. The liquid was filtered by a pore-filter to give a material which is referred to as "latex-B".

Besides, as regards the resin particles in the "latex-B", the glass transition temperature was 58° C., the softening point was 132° C., and the molecular weight distribution was such that the weight-average molecular weight was 245 thousands, and the weight-average particle diameter was 110 nm.

A solution composed of 5.36 kg of sodium chloride as a salting-out agent dissolved in 20.0 L of ion-exchange water was prepared, to be referred to as "sodium chloride solution G".

A solution composed of 1.00 g of fluorine-contained nonion surfactant dissolved in 20.0 L of ion-exchange water was prepared, to be referred to as "nonion surfactant solution H".

20.0 kg of the "latex-A" and 5.2 kg of the "latex-B" which were prepared in the above-mentioned ways respectively, 0.4 kg of the "coloring agent dispersion liquid 1", and 20.0 kg of ion-exchange water were put in a SUS reaction pot having a capacity of 100 L equipped with a temperature sensor, a cooling tube, a nitrogen introducing device, and a device for monitoring the particle diameter and shape (equipped with the stirring planes having the structure shown in FIG. 6(*a*)), and stirred. Subsequently, the liquid was heated to 40° C., and the sodium chloride solution G, 6.00 kg of isopropanol (manufactured by Kanto Chemical Co., Ltd.), and nonion surfactant solution H were added in this order. After that, the liquid was left as it was for 10 minutes, then the temperature raising was started, the liquid temperature was raised to 85° C. in 60 minutes, and the liquid was heated and stirred at 85° C.±2° C. at a number of revolutions of 160 to 165 rpm for 0.5 to 3 hours, to make the particles grow as they were salting out and fused to be bonded to one another. Subsequently, 2.1 L of pure water was added to stop the growth of the particles.

0.5 kg of the fusion-bonded particle dispersion liquid produced in the above-mentioned way was put in a reaction vessel having a capacity of 5 L equipped with a temperature sensor, cooling tube, and a monitoring apparatus for the particle diameter and the shape (equipped with the stirring planes having the structure shown in FIG. 11, and the crossing angle α 20°), and the shape control was performed by heating and stirring the liquid at a liquid temperature of 85° C.±2° C. and at a number of revolutions of 160 to 165 rpm for 0.5 to 15 hours. After that, the liquid was cooled to 40° C. or under, and the stirring was stopped. Next, by means of a centrifugal separator, classification was made in the liquid by a centrifugal sedimentation method, and the liquid was filtered with a sieve having openings of 45$\mu$, to give a filtered liquid, which was made an association liquid. Subsequently, by using a Buchner funnel, aspherical-shaped particles like a wet cake was collected by filtration. After that, the particles were washed with ion-exchange water.

These aspherical-shaped particles were dried by means of a flush jet drier at a suction air temperature of 60° C., and next, the particles were dried at a temperature of 60° C. by means of a fluidized bed drier. Silica fine particles of 1 part by weight were added externally to the obtained colored particles of 100 part by weight and mixed by means of a Henschel mixer; thus, a toner by an emulsion polymerization method employing association process was obtained.

In the monitoring in the above-mentioned salting-out/fusion-bonding process and shape controlling process, the particle diameter and the variation coefficient in the particle diameter distribution were arbitrarily adjusted by classification in the liquid, and toners 1 to 4 composed of toner particles having the shape characteristic and particle diameter distribution characteristic shown in Table 1 described below were obtained.

Each of the toners 1 to 4 which had been obtained in the above-mentioned way was mixed with a ferrite carrier composed of carrier particles having the surface coated with styrene-methacrylate copolymer resin and a volume-average particle diameter of 45 μm at a proportion of the toner 19.8 g and the carrier 200.2 g; thus, developers 1 to 4 having a toner concentration of 9% were prepared.

Example of Practice 1, Example of Practice 2, Example for Comparison 1, and Example for Reference 1

According to the structure of the image forming apparatus shown in FIG. 1, the photoreceptor, the developing device, the toner, the cleaning roller, the cleaning blade, etc. were determined as follows.

1. Photoreceptor

For the photoreceptor (10), it was used a drum-shaped organic photoreceptor consisting of a photosensitive layer having a thickness of 25 μm composed of a polycarbonate film impregnated with a phthalocyanine pigment formed on the outer circumferential surface of a drum-shaped metallic base made of aluminum.

2. Developing Device

As regards the developing device (13), it had such a structure that it was equipped with a developing sleeve (13A) to be driven to rotate at a linear velocity of 370 mm/sec, to which a bias voltage of the same polarity as the surface potential of the photoreceptor (10) was applied, and reverse development was performed with the two-component developer, while the residual toner particles on the photoreceptor (10) were collected from the cleaning device (20) by the collecting transporting mechanism to be utilized again.

3. Cleaning Roller

For the cleaning roller (21), one being made of electrically conductive foamed polyurethane, and having a surface layer resistivity of $10^3$ Ωcm and a hardness of 30° measured on the basis of JIS K6301 was used, and it was arranged in such a way that the nip width formed between the photoreceptor (10) and itself became 2 mm.

Further, to the cleaning roller (21), a scraper made of stainless steel as the collecting member (24) was mounted with its front end portion brought in pressing contact with the surface of the cleaning roller (21) and directed to the reverse direction to the rotating direction of the cleaning roller (21) (counter direction).

The cleaning roller (21) was driven to rotate in such a way that its circumference moved in the same direction as the moving direction of the surface of the photoreceptor (10) at the contact position with the photoreceptor (10), and the linear velocity ratio (Vr/Vp) of the linear velocity of the cleaning roller (21) (Vr) to the linear velocity of the photoreceptor (10) (Vp) was set at 1.

4. Cleaning Blade

For the cleaning blade (23), one having a hardness of 70° measured on the basis of JIS K6301, a thickness of 2.00 mm, and a free length of 10 mm was used.

Further, the cleaning blade (23) was mounted in the state that the contact angle (θ) with the photoreceptor (10) was 10° and the pressing load per unit length against the photoreceptor (10) was 20 g/cm.

In the above-mentioned equipment, the surface potential of the photoreceptor (10) in the unexposed area (Vh) was made to be −750 V, the surface potential of the photoreceptor (10) in the exposed area (Vl) was made to be −100 V, and a development bias voltage of −600 V was applied to the developing sleeve (13A).

Further, by making an electric current of +20 μA flow through the cleaning roller (21) by the bias voltage applying means (23) made up of a constant-current power source, the cleaning roller (21) was charged to an electric potential of +600 V.

By practicing a printing test of 200 thousands sheets using the above-mentioned image forming apparatus, evaluation was made in respect of the presence or absence of the occurrence of black streaks, white streaks, etc. caused by poor cleaning. The printing test was carried out in the environment of the normal temperature and normal humidity (temperature: 20° C., relative humidity: 50%) from 0 to 100 thousands prints, in the environment of the low temperature and low humidity (temperature: 10° C., relative humidity: 20%) from 100 thousands to 150 thousands prints, and in the environment of the high temperature and high humidity (temperature: 30° C., relative humidity: 80%) from 150 thousands to 200 thousands prints. The results were shown collectively in Table 1 noted below.

Further, the measurement of charge quantity was made in such a way that 1 g of the developer was put in a cell provided with a mesh made of stainless steel stretched out, was blown by nitrogen gas at a pressure of 0.2 kg/cm$^2$ for 6 seconds, and the charge of residual carrier particles is measured. From the result obtained, the charge quantity distribution based on the number of particles (refer to FIG. 12) was given, and the width of the charge quantity distribution was calculated.

TABLE 1

| | Toner | Number-average particle diameter D (μm) | Number variation coefficient of particle diameter distribution by number (%) | Sum (M) of toner particles at highest frequency (ml) and those at second highest frequency (m2) (%) | Proportion of toner particles having a charge quantity falling within a range of ±3 femto-C/10 μm with respect to that giving highest frequency (% by number) | Presence or absence of occurrence of image defects caused by poor cleaning |
|---|---|---|---|---|---|---|
| Example 1 | Toner 1 | 5.6 | 25.9 | 80.7 | 92 | good up to 200 thousands prints |
| Example 2 | Toner 2 | 5.7 | 20.7 | 82.3 | 94 | good up to 200 thousands prints |

TABLE 1-continued

| | Toner | Number-average particle diameter D (μm) | Number variation coefficient of particle diameter distribution by number (%) | Sum (M) of toner particles at highest frequency (ml) and those at second highest frequency (m2) (%) | Proportion of toner particles having a charge quantity falling within a range of ±3 femto-C/10 μm with respect to that giving highest frequency (% by number) | Presence or absence of occurrence of image defects caused by poor cleaning |
|---|---|---|---|---|---|---|
| Example for reference 1 | Toner 3 | 5.6 | 26.8 | 67.0 | 68 | occur a little at 140 thousandth print |
| Comparative Example 1 | Toner 4 | 5.6 | 28.7 | 64.8 | 65 | occur remarkably at 110 thousandth print |

As described in the above, it was confirmed that, by the image forming apparatus of this invention of the example of practice 1 and the example of practice 2, without being highly influenced by the change of the environment, a high cleaning effect could be exhibited with certainty, and a high-quality image could be stably formed over a long period of time. Further, as regards the image forming apparatus of this invention of the example for reference 1, it was confirmed that a little black streaks and/or white streaks occurred, but the amount was of such a degree as not to pose a problem practically.

On the other hand, as regards the image forming apparatus of the example for comparison 1, it was confirmed that, at the timing when 110 thousands prints had been made, the occurrence of image defects caused by poor cleaning took place remarkably.

Further, in the monitoring in the above-mentioned salting-out/fusion-bonding process and shape controlling process, the particle diameter and the variation coefficient of the particle diameter distribution were arbitrarily adjusted by classification in the liquid, and toners 5 to 9 composed of toner particles having the shape characteristic and particle diameter distribution characteristic shown in Table 2 noted below were obtained.

Each of the toners 5 to 9 which had been obtained in the above-mentioned way was mixed with a ferrite carrier composed of carrier particles having the surface coated with styrene-methacrylate copolymer resin and a volume-average particle diameter of 45 μm at a proportion of the toner 19.8 g and the carrier 200.2 g, and developers 5 to 9 having a toner concentration of 9% were prepared.

Example of Practice 3, Example of Practice 4, Examples for Comparison 2 to 4

According to the structure of the image forming apparatus shown in FIG. 1, the photoreceptor, the developing device, the toner, the cleaning roller, the cleaning blade, etc. were determined as follows.

1. Photoreceptor

For the photoreceptor (10), it was used a drum-shaped organic photoreceptor consisting of a photosensitive layer having a thickness of 25 μm composed of a polycarbonate film impregnated with a phthalocyanine pigment formed on the outer circumferential surface of a drum-shaped metallic base made of aluminum.

2. Developing Device

As regards the developing device (13), it had such a structure that it was equipped with a developing sleeve (13A) to be driven to rotate at a linear velocity of 370 mm/sec, to which a bias voltage of the same polarity as the surface potential of the photoreceptor (10) was applied, and reverse development was performed with the two-component developer, while the residual toner particles on the photoreceptor (10) were collected from the cleaning device (20) by the collecting transporting mechanism to be utilized again.

3. Cleaning Roller

For the cleaning roller (21), one being made of electrically conductive foamed polyurethane, and having a surface layer resistivity of $10^3$ Ωcm and a hardness of 30 measured on the basis of JIS K6301 was used, and it was arranged in such a way that the nip width formed between the photoreceptor (10) and itself became 2 mm.

Further, to the cleaning roller (21), a scraper made of stainless steel as the collecting member (24) was mounted with its front end portion brought in pressing contact with the surface of the cleaning roller (21) and directed to the reverse direction to the rotating direction of the cleaning roller (21) (counter direction).

The cleaning roller (21) was driven to rotate in such a way that its circumference moved in the same direction as the moving direction of the surface of the photoreceptor (10) at the contact position with the photoreceptor (10), and the linear velocity ratio (Vr/Vp) of the linear velocity of the cleaning roller (21) (Vr) to the linear velocity of the photoreceptor (10) (Vp) was set at 1.

4. Cleaning Blade

For the cleaning blade (23), one having a hardness of 70° measured on the basis of JIS K6301, a thickness of 2.00 mm, and a free length of 10 mm was used.

Further, the cleaning blade (23) was mounted in the state that the contact angle (θ) with the photoreceptor (10) was 10° and the pressing load against the photoreceptor (10) was 20 g/cm.

In the above-mentioned equipment, the surface potential of the photoreceptor (10) in the unexposed area (Vh) was made to be −750 V, the surface potential of the photoreceptor (10) in the exposed area (Vl) was made to be −100 V, and a development bias voltage of −600 V was applied to the developing sleeve (13A).

Further, by making an electric current of +20 μA flow through the cleaning roller (21) by the bias voltage applying means (23) made up of a constant-current power source, the cleaning roller (21) was charged to an electric potential of +600 V.

By practicing a printing test of 200 thousands sheets using the above-mentioned image forming apparatus, evaluation was made for the presence of absence of the occurrence of black streaks, white streaks, etc. caused by poor cleaning.

The printing test was carried out in the environment of the normal temperature and normal humidity (temperature: 20° C., relative humidity: 50%) from 0 to 100 thousands prints, in the environment of the low temperature and low humidity (temperature: 10° C., relative humidity: 20%) from 100 thousands to 150 thousands prints, and in the environment of the high temperature and high humidity (temperature: 30° C., relative humidity: 80%) from 150 thousands to 200 thousands prints. The results were shown collectively in Table 2 noted below.

Further, the measurement of charge quantity was made in such a way that 1 g of the developer was put in a cell provided with a mesh made of stainless steel stretched out, was blown by nitrogen gas at a pressure of 0.2 kg/cm$^2$ for 6 seconds, and the charge of residual carrier particles is measured. From the result obtained, the charge quantity distribution based on the number of particles (refer to FIG. 12) was given, and the width of the charge quantity distribution was calculated.

TABLE 2

| | Toner | Proportion of toner particles having a shape coefficient falling within a range of 1.0 to 1.6 (% by number) | Proportion of toner particles having a shape coefficient falling within a range of 1.2 to 1.6 (% by number) | Variation coefficient of shape coefficient (%) | Number-average particle diameter D ($\mu$m) | Proportion of toner particles having a charge quantity falling within a range of ±3 femto-C/10 $\mu$m with respect to that giving highest frequency (% by number) | Presence or absence of occurrence of image defects caused by poor cleaning |
|---|---|---|---|---|---|---|---|
| Example 3 | Toner 5 | 82.5 | 68.3 | 15.2 | 5.6 | 92 | good up to 200 thousands prints |
| Example 4 | Toner 6 | 91.2 | 73.2 | 12.1 | 5.7 | 93 | good up to 200 thousands prints |
| Comparative Example 2 | Toner 7 | 63.9 | 62.0 | 17.4 | 5.5 | 62 | occur remarkably at 80 thousandth print |
| Comparative Example 3 | Toner 8 | 63.6 | 62.1 | 15.3 | 5.5 | 65 | occur remarkably at 130 thousandth print |
| Comparative Example 4 | Toner 9 | 87.6 | 67.6 | 17.9 | 5.6 | 63 | occur remarkably at 150 thousandth print |

As described in the above, it was confirmed that, by the image forming apparatus of this invention of the example of practice 3 and example of practice 4, without being highly influenced by the change of the environment, a high cleaning effect could be exhibited with certainty, and a high-quality image could be stably formed over a long period of time.

On the other hand, it was confirmed that, in the image forming apparatus of the example for comparison 2, at the timing when 80 thousands prints had been made, in the image forming apparatus of the example for comparison 3, at the timing when 130 thousands prints had been made, and in the image forming apparatus of the example for comparison 3, at the timing when 150 thousands prints had been made, the occurrence of image defects caused by poor cleaning took place remarkably.

By an image forming method of this invention, in the case where toner particles remaining on the image carrying member are removed by a cleaning method using both electrostatic cleaning by a cleaning roller and mechanical cleaning by a cleaning blade, a high cleaning effect can be exhibited with certainty and residual toner particles on the image carrying member can be removed with certainty; hence, a high-quality image can be stably formed over a long period of time.

By an image forming apparatus of this invention, in the case where toner particles remaining on the image carrying member are removed by a cleaning method using both electrostatic cleaning by a cleaning roller and mechanical cleaning by a cleaning blade, a high cleaning effect can be exhibited with certainty and residual toner particles on the image carrying member can be removed with certainty; hence, a high-quality image can be stably formed over a long period of time.

What is claimed is:

1. A method of forming an image, comprising:

forming a toner image by developing a latent image on an image carrying member being rotated in a predetermined rotating direction with toner, wherein the toner contains toner particles having a shape coefficient falling within a range of 1.0 to 1.6 in an amount of 65% by number or more and the toner particles has a variation coefficient of the shape coefficient of 16% or less;

transferring the toner image from the image carrying member to a recording material; and cleaning residual toner remaining on the image carrying member after the step of transferring;

the cleaning step comprising;

removing electrostatically residual toner by contacting a surface of the image carrying member with a cleaning roller and by applying a bias voltage between the cleaning roller and the image carrying member, by a constant-current power source, and thereafter, removing mechanically residual toner by contacting the surface of the image carrying member with a tip end of a cleaning blade at a position downstream of the cleaning roller in terms of the rotating direction of the image carrying member.

2. The method of claim 1, wherein the toner contains toner particles having a shape coefficient falling within a range of 1.2 to 1.6 in an amount of 65 number % or more.

3. The method of claim 1, wherein the toner contains toner particles having a number-average particle diameter of 3 to 8 $\mu$m.

4. The method of claim 1, wherein the toner contains toner particles obtained by polymerizing a polymerizable monomer in a water-based medium.

5. The method of claim 1, wherein the toner contains toner particles obtained by associating resin particles in a water-based medium.

6. The method of claim 1, further comprising steps of:

collecting the residual toner removed by the cleaning step; and conveying the collected toner to a developing device so that the residual toner is recycled.

7. A method of forming an image, comprising:

forming a toner image by developing a latent image on an image carrying member being rotated in a predetermined rotating direction with toner, wherein the toner contains toner particles having a number variation coefficient of 27% or less in number-diameter distribution;

transferring the toner image from the image carrying member to a recording material; and cleaning residual toner remaining on the image carrying member after the step of transferring;

the cleaning step comprising;

removing electrostatically residual toner by contacting a surface of the image carrying member with a cleaning roller and by applying a bias voltage between the cleaning roller and the image carrying member by a constant-current power source, and thereafter, removing mechanically residual toner by contacting a surface of the image carrying member with a tip end of a cleaning blade at a position downstream of the cleaning roller in terms of the rotating direction of the image carrying member.

8. The method of claim 7, wherein the toner contains toner particles having a shape coefficient falling within a range of 1.2 to 1.6 in an amount of 65 number % or more.

9. The method of claim 7, wherein when D($\mu$m) represents the particle diameter of toner particles, in a histogram showing a particle diameter distribution based on the number of the particles in which natural logarithm lnD represents the abscissa of the histogram and the abscissa is divided into a plurality of classes at intervals of 0.23, the sum (M) of the relative frequency (m1) of the toner particles included in the highest-frequency class and the relative frequency (m2) of the toner particles included in the class of the next highest-frequency to the highest-frequency class is 70% or more.

10. The method of claim 7, wherein the toner contains toner particles obtained by polymerizing a polymerizable monomer in a water-based medium.

11. The method of claim 7, wherein the toner contains toner particles obtained by associating resin particles in a water based medium.

12. The method of claim 7, further comprising steps of:

collecting the residual toner removed by the cleaning step; and conveying the collected toner to a developing device so that the residual toner is recycled.

13. An apparatus of for forming an image, comprising:

an image carrying member being rotated in a predetermined rotating direction;

a developing device to develop a latent image on the image carrying member with a toner so as to form a toner image, wherein the toner contains toner particles having a shape coefficient falling within a range of 1.0 to 1.6 in an amount of 65% by number or more and the toner particles has a variation coefficient of the shape coefficient of not greater than 16%;

a transferring device to transfer the toner image from the image carrying member to a recording material; and a cleaning device to clean residual toner remaining on the image carrying member and including:

a cleaning roller provided side by side to the image carrying member so as to come in contact with a surface of the image carrying member;

a bias voltage applying section to apply a bias voltage between the cleaning roller and the image carrying member by a constant-current power source so that residual toner is electrostatically removed; and a cleaning blade provided such that a tip end of the cleaning blade is in contact with a surface of the image carrying member at a position downstream of the cleaning roller in terms of the rotating direction of the image carrying member so that residual toner is mechanically removed.

14. The apparatus of claim 13, wherein the toner contains toner particles having a shape coefficient falling within a range of 1.2 to 1.6 in an amount of 65 number % or more.

15. The apparatus of claim 13, wherein the toner contains toner particles having a number-average particle diameter of 3 to 8 $\mu$m.

16. The apparatus of claim 13, wherein the toner contains toner particles obtained by polymerizing a polymerizable monomer in a water-based medium.

17. The apparatus of claim 13, wherein the toner contains toner particles obtained by associating resin particles in a water-based medium.

18. The apparatus of claim 13, further comprising:

a collecting conveying device to collect toner removed by the cleaning device and to convey the collected toner to the developing device.

19. An apparatus of for forming an image, comprising:

an image carrying member being rotated in a predetermined rotating direction;

a developing device to develop a latent image on the image carrying member with a toner so as to form a toner image, wherein the toner contains toner particles having a number variation coefficient of 27% or less in number diameter distribution;

a transferring device to transfer the toner image from the image carrying member to a recording material; and a cleaning device to clean residual toner remaining on the image carrying member and including:

a cleaning roller provided side by side to the image carrying member and in contact with a surface of the image carrying member;

a bias voltage applying section to apply a bias voltage between the cleaning roller and the image carrying member by a constant-current power source so that residual toner is electrostatically removed; and a cleaning blade provided such that a tip end of the cleaning blade is in contact with the surface of the image carrying member at a position downstream of the cleaning roller in terms of the rotating direction of the image carrying member so that residual toner is mechanically removed.

20. The apparatus of claim 19, wherein the toner contains toner particles having a number-average particle diameter of 3 to 8 $\mu$m.

21. The apparatus of claim 19, wherein when D($\mu$m) represents the particle diameter of toner particles, in a histogram showing a particle diameter distribution based on the number of the particles in which natural logarithm lnD represents the abscissa of the histogram and the abscissa is divided into a plurality of classes at intervals of 0.23, the sum (M) of the relative frequency (m1) of the toner particles included in the highest-frequency class and the relative frequency (m2) of the toner particles included in the class of the next highest-frequency to the highest frequency class is 70% or more.

22. The apparatus of claim 19, wherein the toner contains toner particles obtained by polymerizing a polymerizable monomer in a water-based medium.

23. The apparatus of claim 19, wherein the toner contains toner particles obtained by associating resin particles in a water-based medium.

24. The apparatus of claim 19, further comprising:

a collecting conveying device to collect toner removed by the cleaning device and to convey the collected toner to the developing device.

25. The method of claim 1, wherein the constant-current power source applies as electric current of 1 to 50 $\mu$A to the cleaning roller.

26. The method of claim 25, wherein the electric current is 5 to 40 $\mu$A.

27. The method of claim 7, wherein the constant-current power source applies an electric current of 1 to 50 $\mu$A to the cleaning roller.

28. The method of claim 27, wherein the electric current is 5 to 40 $\mu$A.

29. The apparatus of claim 13, wherein the constant-current power applies an electric current of 1 to 50 $\mu$A to the cleaning roller.

30. The apparatus of claim 29, wherein the electric current is 5 to 40 $\mu$A.

31. The apparatus of claim 19, wherein the constant-current power source applies an electric current of 1 to 50 $\mu$A to the cleaning roller.

32. The apparatus of claim 31, wherein the electric current is 5 to 40 $\mu$A.

* * * * *